US011112721B2

(12) United States Patent
Horiuchi

(10) Patent No.: US 11,112,721 B2
(45) Date of Patent: Sep. 7, 2021

(54) IMAGE FORMING APPARATUS

(71) Applicant: CANON KABUSHIKI KAISHA, Tokyo (JP)

(72) Inventor: Izuru Horiuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/846,997

(22) Filed: Apr. 13, 2020

(65) Prior Publication Data

US 2020/0333723 A1 Oct. 22, 2020

(30) Foreign Application Priority Data

Apr. 18, 2019 (JP) ..... JP2019-079107

(51) Int. Cl.
*G03G 15/043* (2006.01)

(52) U.S. Cl.
CPC ..... *G03G 15/043* (2013.01)

(58) Field of Classification Search
None
See application file for complete search history.

(56) References Cited

U.S. PATENT DOCUMENTS 9,658,560 B2 5/2017 Yokoi
2015/0346628 A1* 12/2015 Yokoi ..... G03G 15/04054 347/118

FOREIGN PATENT DOCUMENTS

JP 2012-245772 A 12/2012
JP 2015-229246 A 12/2015

* cited by examiner

*Primary Examiner* — Jas A Sanghera
(74) *Attorney, Agent, or Firm* — Venable LLP

(57) ABSTRACT

An image forming apparatus includes a photosensitive member, an exposure portion including surface light emitting element arrays each including light emitting elements, and a clock generating portion. The clock generating portion generates a reference clock signal and a spread spectrum modulation clock signal. The exposure portion exposes the photosensitive member to light by sequentially subjecting a predetermined number of the light emitting elements to light emission control on the basis of a signal obtained by subjecting the modulation clock signal to modulation with image data. A modulation cycle in which a frequency of the modulation clock signal is modulated is n times (n: integer of n>1) an exposure cycle which is a time in which the light emitting elements are subjected to the light emission control on the basis of the reference clock signal.

7 Claims, 17 Drawing Sheets

(a)

(b)

| | PWM DATA | | | | | | |
|---|---|---|---|---|---|---|---|
| 000 | 0 | 0 | 0 | 0 | 0 | 0 | 0 |
| 001 | 0 | 0 | 0 | 0 | 0 | 1 | 1 |
| 010 | 0 | 0 | 0 | 0 | 1 | 1 | 1 |
| 011 | 0 | 0 | 1 | 1 | 1 | 1 | 1 |
| 100 | 1 | 1 | 1 | 1 | 1 | 1 | 1 |

(c)

| | PWM DATA | | | | | | |
|---|---|---|---|---|---|---|---|
| 000 | 0 | 0 | 0 | 0 | 0 | 0 | 0 |
| 001 | 1 | 1 | 0 | 0 | 0 | 0 | 0 |
| 010 | 1 | 1 | 1 | 1 | 0 | 0 | 0 |
| 011 | 1 | 1 | 1 | 1 | 1 | 1 | 0 |
| 100 | 1 | 1 | 1 | 1 | 1 | 1 | 1 |

(d)

| | PWM DATA | | | | | | |
|---|---|---|---|---|---|---|---|
| 000 | 0 | 0 | 0 | 0 | 0 | 0 | 0 |
| 001 | 0 | 0 | 0 | 1 | 1 | 0 | 0 |
| 010 | 0 | 0 | 1 | 1 | 1 | 1 | 0 |
| 011 | 0 | 1 | 1 | 1 | 1 | 1 | 0 |
| 100 | 1 | 1 | 1 | 1 | 1 | 1 | 1 |

IMAGE FORMING APPARATUS

FIELD OF THE INVENTION AND RELATED ART

The present invention relates to an image forming apparatus of an electrophotographic type.

In a printer which is an electrophotographic image forming apparatus, the following exposure method (type) in which a photosensitive drum is exposed to light by using an exposure head and a latent image is formed is generally known. Incidentally, as an exposure head, an LED (Light Emitting Diode), an organic EL (Organic Electro Luminescence) or the like is used. The exposure head comprises a light emitting element array arranged in the longitudinal direction of the photosensitive drum, and a rod lens array which forms an image of light from the light emitting element array on the photosensitive drum. LEDs and organic ELs having a surface-emitting shape in which the direction of light emitted from the light-emitting surface is the same as that of the rod lens array are known. Here, the length of the light emitting element array is determined depending on the width of the image area on the photosensitive drum, and the interval between the light emitting elements is determined according to the resolution of the printer. For example, in the case of a 1200 dpi printer, the pixel spacing is 21.16 μm, and therefore, the spacing between the adjacent light emitting elements is also the spacing corresponding to 21.16 μm. In the case of an image forming apparatus capable of printing an image on an A3-size (width: 297 mm) sheet with this element spacing, at least 14031 light emitting elements are arranged. In the case where these light emitting elements are mounted on a printed board, the number of the light emitting elements is large, so that a mounting cost becomes high. For that reason, conventionally, a type in which a plurality of light emitting element arrays are formed on a single semiconductor chip (hereinafter referred to as a surface light emitting element array chip) and thus the mounting number of the light emitting element arrays on the printed board is made small has been used. For example, in the case where 500 light emitting elements are formed on a single surface light emitting element array chip, on the printed board, by mounting 29 surface light emitting element array chips, an image can be formed in an image area width of the A3-size (width: 297 mm). Further, as regards the light emitting elements of the surface light emitting element array chip, scanning control is carried out by sequentially turning on a predetermined number of the light emitting elements from an end (terminal) light emitting element, so that an increase in the number of signal lines connecting a driver for driving the surface light emitting element array chip with the surface light emitting element array chip can be suppressed. Further, timing when the driver supplies a current to each of the light emitting elements of the surface light emitting element array chip can be distributed, and therefore, a supply amount of the current supplied from the driver to the surface light emitting element at once can be suppressed to a predetermined range. In the following, the longitudinal direction of the photosensitive drum is referred to as a main scan direction, and a rotational direction of the photosensitive drum is referred to as a sub-scan direction. Thus, by employing a constitution in which the plurality of light emitting elements are formed on a single surface light emitting element array chip, a mounting cost can be lowered. In a printer using such an exposure head, compared with a printer of a laser scanning type in which a photosensitive drum is scanned with a laser beam deflected by a rotating polygonal mirror, a smaller number of component parts is used, and therefore, downsizing of equipment and cost reduction are easy.

On the other hand, the exposure head includes a circuit board which covers an exposure range of the photosensitive drum with respect to the main scan direction which is the longitudinal direction and which has an elongated thin shape, and on the circuit board, wiring of a driving signal for the surface light emitting element array chip is formed. For that reason, a constitution in which the wiring of the driving signal for the surface light emitting element array chip performs a function of an antenna and is liable to constitute a generation source of radiation noise is formed. As a countermeasure against the radiation noise, there is a method using a spread spectrum clock generator (hereinafter referred to as SSCG) for suppressing a peak frequency gain of a radiation noise component by subjecting a system clock to modulation. However, when the SSCG is used for generating the driving signal for causing the surface light emitting elements to emit light, a cycle (cycle period) of the system clock is fluctuated, and therefore, there is a liability of a lowering in image quality due to a clock cycle fluctuation. Parts (a) to (d) of FIG. 12 are schematic views for illustrating a relationship between the system clock, an SSCG clock, a cycle of the SSCG clock and PWM signals generated in synchronism with a multiplied clock of the SSCG clock. As shown in parts (a) to (d) of FIG. 12, by modulating the cycle of the SSCG clock, an image exposure time fluctuates even at the same image density, and therefore, it is understood that cycle non-uniformity of the image density occurs.

Next, parts (a) and (b) of FIG. 13 are schematic views for illustrating a relationship between the surface light emitting element array chip and a modulation cycle (period) of the SSCG. Parts (a) and (b) of FIG. 13 are the schematic views showing the case where an exposure scanning cycle (period) of the surface light emitting element array chip is n times (n: speed integer) of the modulation cycle of the SSCG. Part (b) of FIG. 13 shows a frequency deviation of the SSCG of a first line and a second line with respect to the sub-scan direction in each of the cases of n=1, 2 and 3. Incidentally, one cycle (period) of the SSCG is constituted by the former half cycle (period) in which the frequency decreases and the latter half cycle (period) in which the frequency increases. On the other hand, part (a) of FIG. 13 shows a state of a density fluctuation with a frequency fluctuation by the SSCG in a single surface light emitting element array chip. Part (a) of FIG. 13 shows the density fluctuation of the surface light emitting element array chip of the first line and the second line with respect to the sub-scan direction in each of the cases of n=1, 2 and 3, and corresponds to a graph of part (b) of FIG. 13. Incidentally, the abscissa represents time, and "SSCG W.L. (wavelength)" represents a length of one cycle (period) of the SSCG. In each of the respective graphs of part (a) of FIG. 13, in the case where the frequency of the SSCG decreases, i.e., the deviation of the modulation frequency is negative, the clock cycle (period) becomes long, with the result that a density of the image formed becomes thick (represented by "DARK" in the figure). On the other hand, in the case where the frequency of the SSCG increases, i.e., the deviation of the modulation frequency is positive, the clock cycle (period) becomes short, with the result that the density of the image becomes thin (represented by "LIGHT" in the figure). Further, in the case where the exposure scanning cycle (period) of the surface light emitting element array chip is n times (n: integer) the cycle (period) at the modulation frequency of the SSCG, as shown in part (a) of FIG. 13, the same density areas are arranged in the sub-scan direction, and therefore, due to light and dark density fluctuation, cycle (period) non-uniformity with respect to the main scan direction is conspicuous.

For that reason, for example, in Japanese Laid-Open Patent Application (JP-A) 2012-245772 and JP-A 2015-229246, a method of canceling the density fluctuation by setting the exposure scanning cycle (period) of the single surface light emitting element array chip at a cycle (period) which is (n+½) times (n: positive integer) of the SSCG cycle (period) has been proposed. That is, in exposure scanning of adjacent lines with respect to the sub-scan direction, a phase of the modulation frequency of the SSCG is reversed, whereby an increase and a decrease of the exposure time due to the frequency modulation are balanced with each other, so that the light and dark density fluctuation is canceled. FIG. 14 is a schematic view for illustrating a state in which the density fluctuation with respect to the main scan direction is canceled by setting the exposure scanning cycle of the single surface light emitting element array chip at a cycle which is (n+½) times (n: positive integer) the SSCG cycle. Thus, when the phase of the modulation frequency of the SSCG is reversed between the adjacent lines with respect to the sub-scan direction, as shown in FIG. 14, the increase and the decrease of the exposure amounts of the adjacent lines are averaged between adjacent pixels with respect to the sub-scan direction. As a result, regular light and dark pattern is not readily visually recognized, so that the density fluctuation is canceled.

Parts (a) and (b) of FIG. 15 are schematic views for illustrating a relationship between the above-described surface light emitting element array chips and the modulation cycle (period) of the SSCG. Part (a) of FIG. 15 shows a density fluctuation of surface light emitting element array chips on the first and second lines with respect the sub-scan direction in each of the cases of n=1, 2 and 3 from above, and corresponds to the graphs of part (b) of FIG. 15. As shown in part (a) of FIG. 15, in the case where the exposure scanning cycle of the light emitting elements of the surface light emitting element array chip from one end to the other end is (n+½) times (n: integer) the cycle of the modulation frequency of the SSCG, regions increased and decreased in exposure amount are alternately arranged in the sub-scan direction. For that reason, the light and dark cycle non-uniformity with respect to the main scan direction can be made visually inconspicuous. Incidentally, detailed descriptions of FIGS. 12 to 15 will be presented later.

However, when the condition such that the exposure scanning cycle of the surface light emitting element array chip is (n+½) times (n: positive integer) the cycle of the SSCG is applied to an actual member, the increase (increment) and the decrease (decrement) of the exposure amount cannot be completely canceled, so that a residual component remains in some cases. For example, as described above with reference to FIG. 14, in the case where image data of the adjacent lines with respect to the sub-scan direction have the same density, the increment and the decrement of the exposure amount are the same, and therefore, the density fluctuation is canceled. FIG. 16 is a schematic view showing a state of a density fluctuation in the case where the exposure scanning cycle of the single surface light emitting element array chip is set at a cycle which is (n+½) times (n: positive integer) the cycle of the SSCG and the image density is different between the adjacent lines with respect to the sub-scan direction. In FIG. 16, N line and (N+1) line are 75% in image density, and (N+2) line and (N+3) line are 50% in image density. As shown in FIG. 16, absolute values of the increment and the decrement of the exposure amount shown by the PWM waveforms are proportional to the image density, but deviation in light emitting element arrangement direction generates when the surface light emitting element array chip is viewed microscopically (on one pixel basis), whereas the deviation in the light emitting element arrangement direction does not generate when the surface light emitting element array chip is viewed macroscopically (on plural pixel basis). As a result, the deviation is not visually recognized even when the cycle of the SSCG is fluctuated, but a residual component generates depending on a spatial frequency and the light and dark cycle non-uniformity with respect to the main scan direction becomes visually conspicuous, so that the deviation is visually recognized in some instances. For that reason, there arises a problem that the light and dark residual component with respect to the main scan direction is controlled so as to be made visually inconspicuous.

SUMMARY OF THE INVENTION

The present invention has been accomplished in the above-described circumstances, and a principal object of the present invention is to provide an image forming apparatus capable of controlling a light and dark residual component with respect to a main scan direction so as to be made visually inconspicuous.

According to an aspect of the present invention, there is provided an image forming apparatus comprising: a photosensitive member rotatable in a first direction; an exposure portion including a plurality of surface light emitting element arrays arranged in a second direction substantially perpendicular to the first direction and configured to expose the photosensitive member to light by the surface light emitting element arrays; and a clock generating portion configured to generate a clock signal, wherein the clock generating portion generates a reference clock signal for controlling light emission timing and a spread spectrum modulation clock signal obtained by subjecting the reference clock signal to frequency modulation, wherein each of the surface light emitting element arrays includes a plurality of light emitting elements for exposing the photosensitive member to light, wherein the exposure portion exposes the photosensitive member to light by sequentially subjecting a predetermined number of the light emitting elements of each of the surface light emitting element arrays to light emission control on the basis of a signal obtained by subjecting the modulation clock signal to modulation with image data, and wherein a modulation cycle in which a frequency of the modulation clock signal is modulated is n times (n: integer of n>1) an exposure cycle which is a time in which the light emitting elements of each of the surface light emitting element arrays are subjected to the light emission control on the basis of the reference clock signal.

Further features of the present invention will become apparent from the following description of exemplary embodiments with reference to the mounted drawings.

Figure 2:
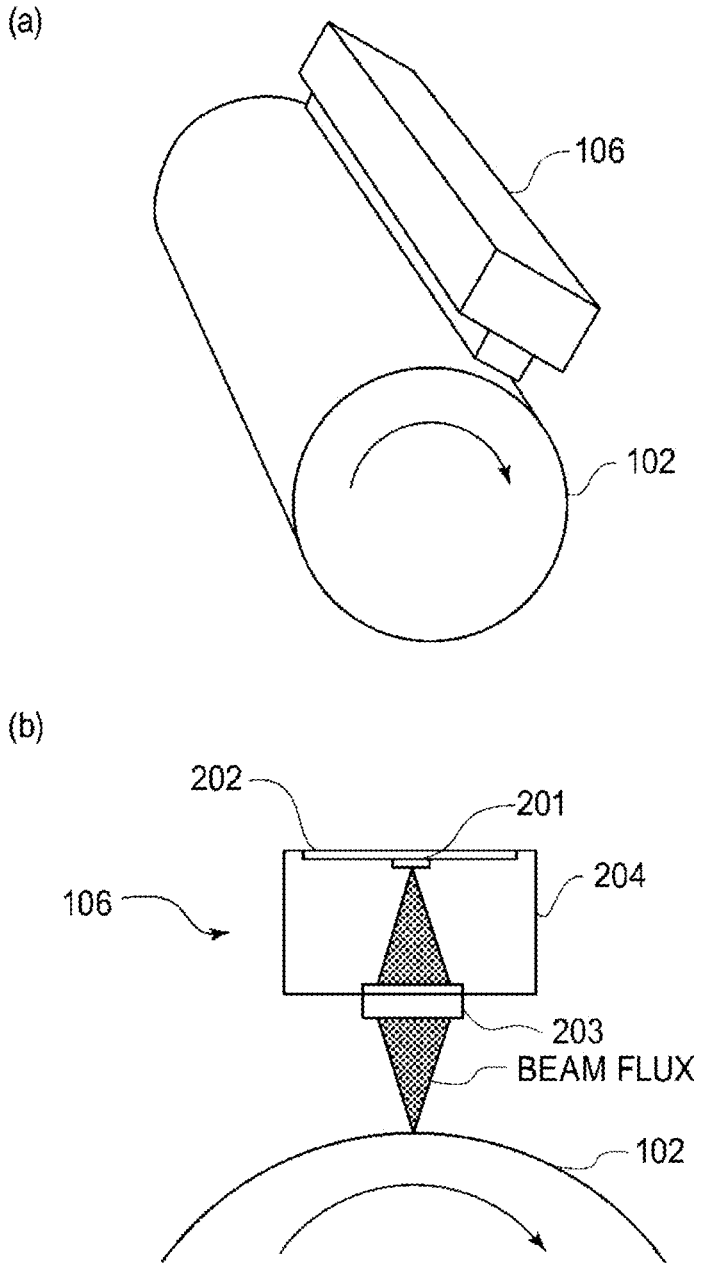

Part (a) of FIG. 2 is a schematic view illustrating a positional relationship between an exposure head and a photosensitive drum in the embodiments 1 and 2, and part (b) of FIG. 2 is a schematic view illustrating a structure of an exposure head in the embodiments 1 and 2.

Figure 3:
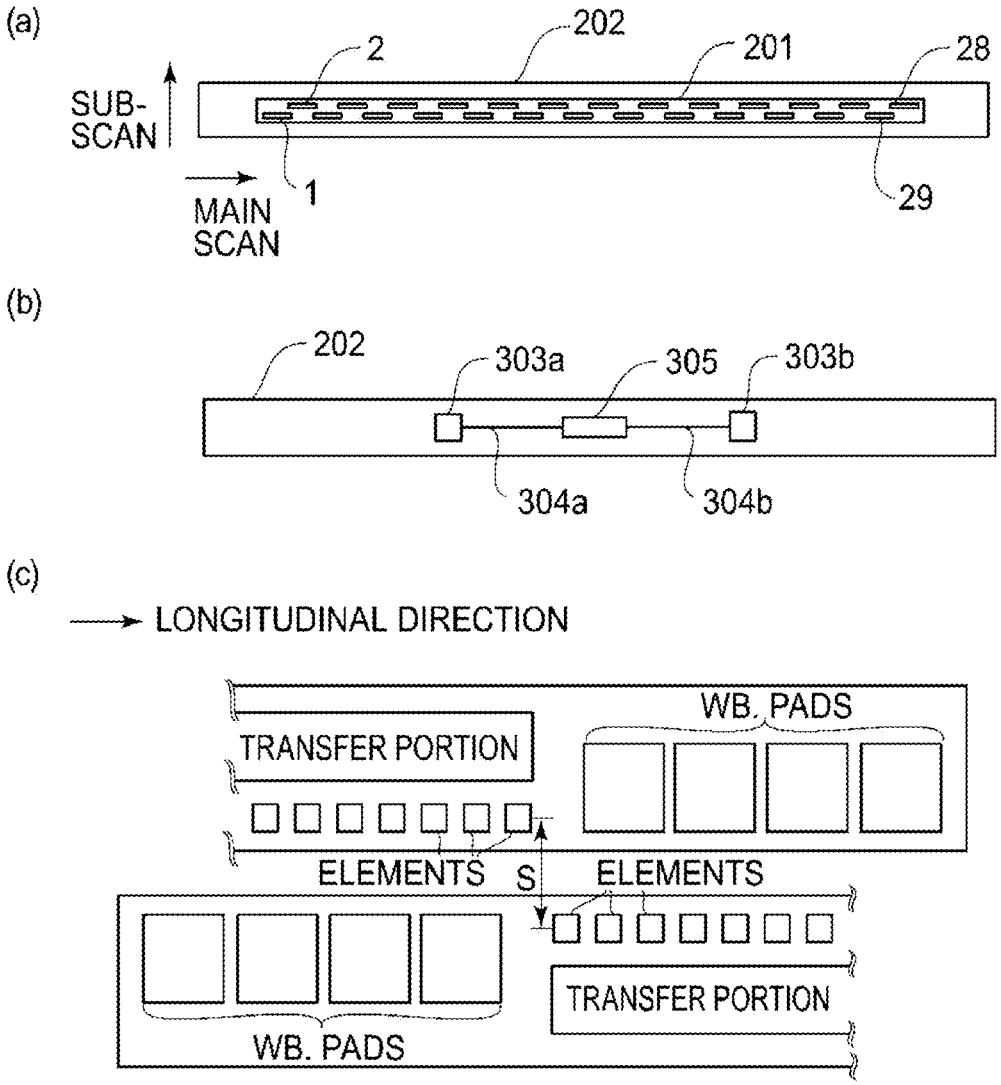

Parts (a), (b) and (c) of FIG. 3 are schematic illustrations of a drive substrate in the embodiments 1 and 2, and an illustration of a structure of a surface light emitting element array chip in the embodiments 1 and 2.

Figure 4:
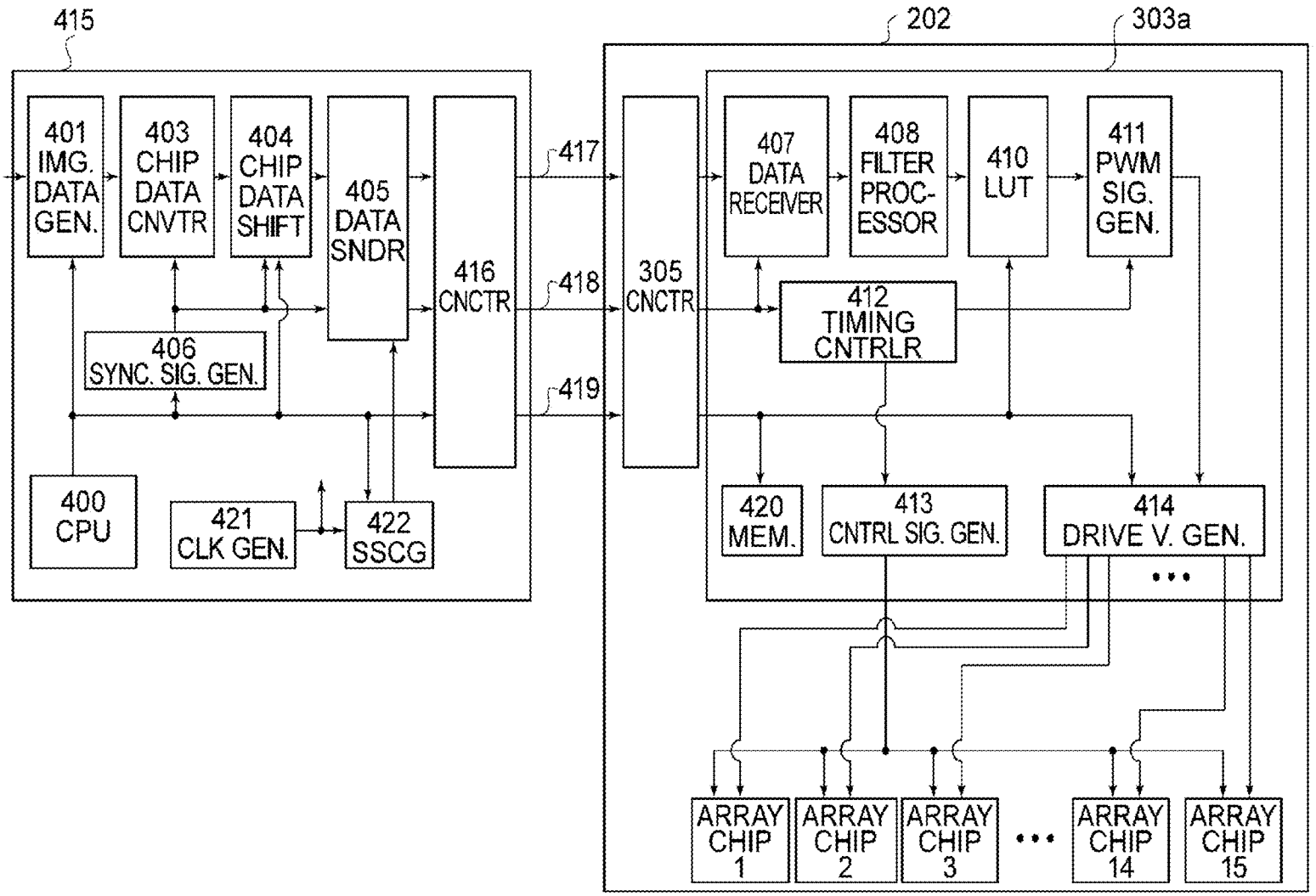

FIG. 4 is a control block diagram of a control substrate and the drive substrate in the embodiments 1 and 2.

Figure 5:
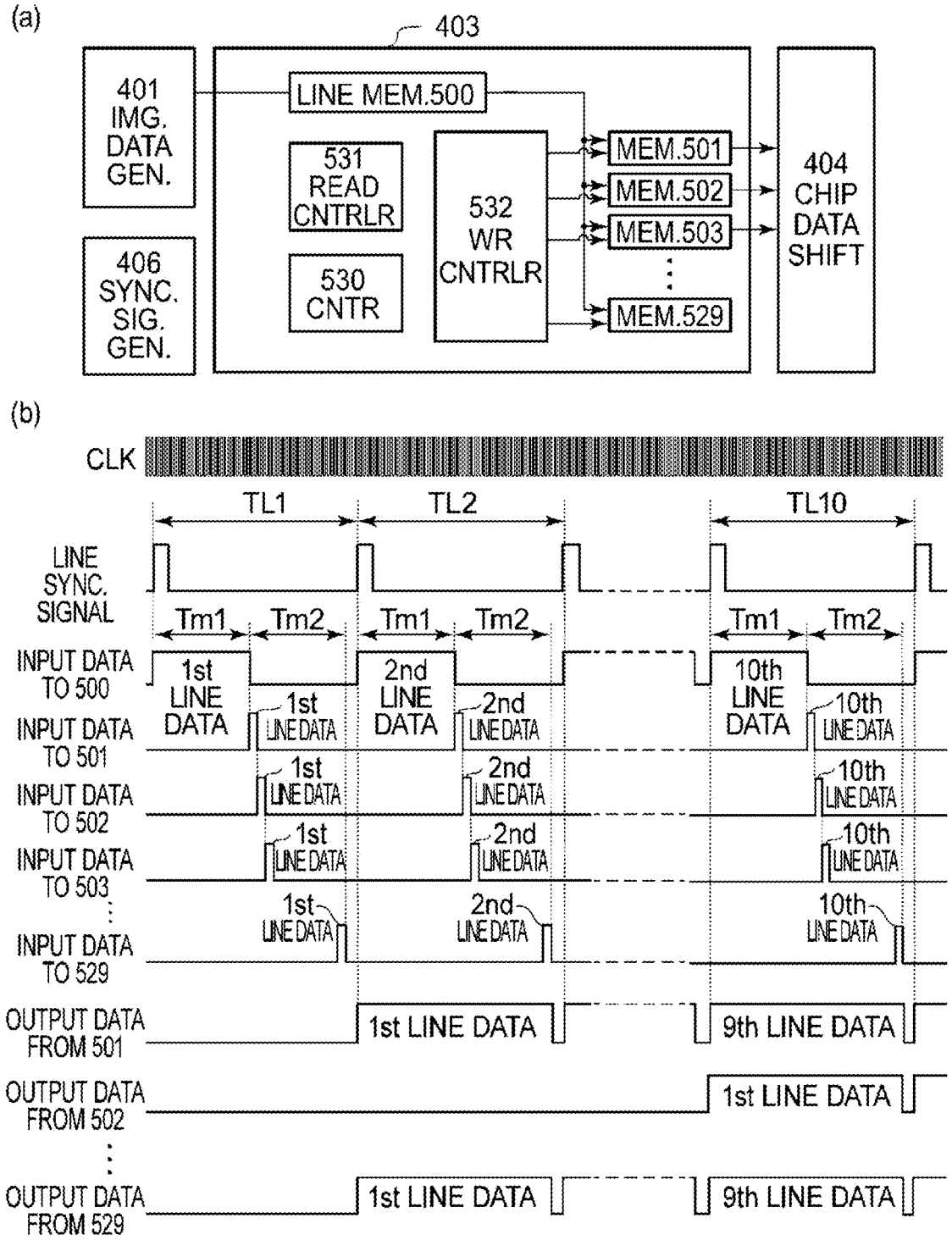

Part (a) and (b) of FIG. 5 are a control block diagram and a timing chart of a chip data converting portion in the embodiments 1 and 2.

Figure 6:
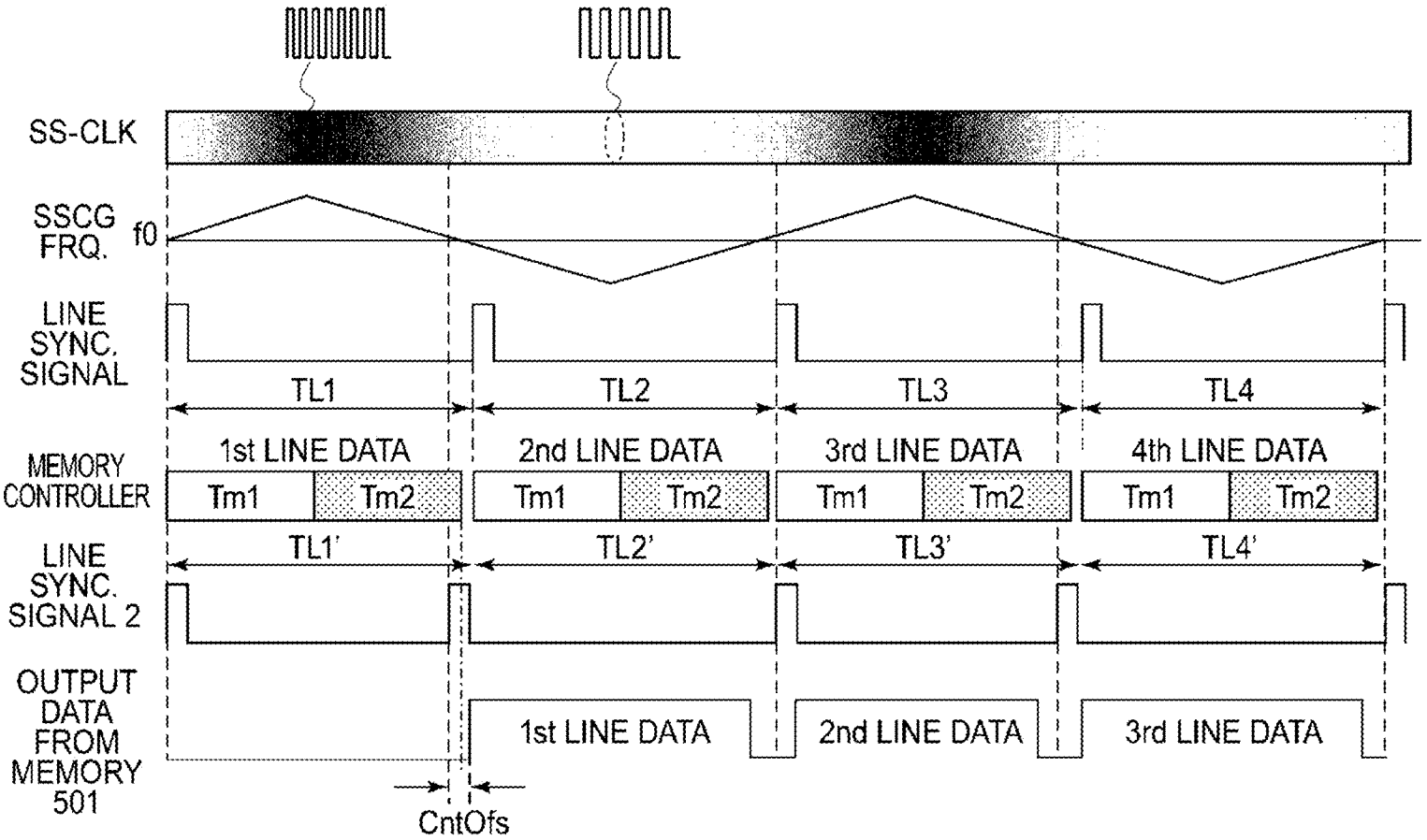

FIG. 6 is a timing chart of the chip data converting portion in the embodiment 1.

Figure 7:
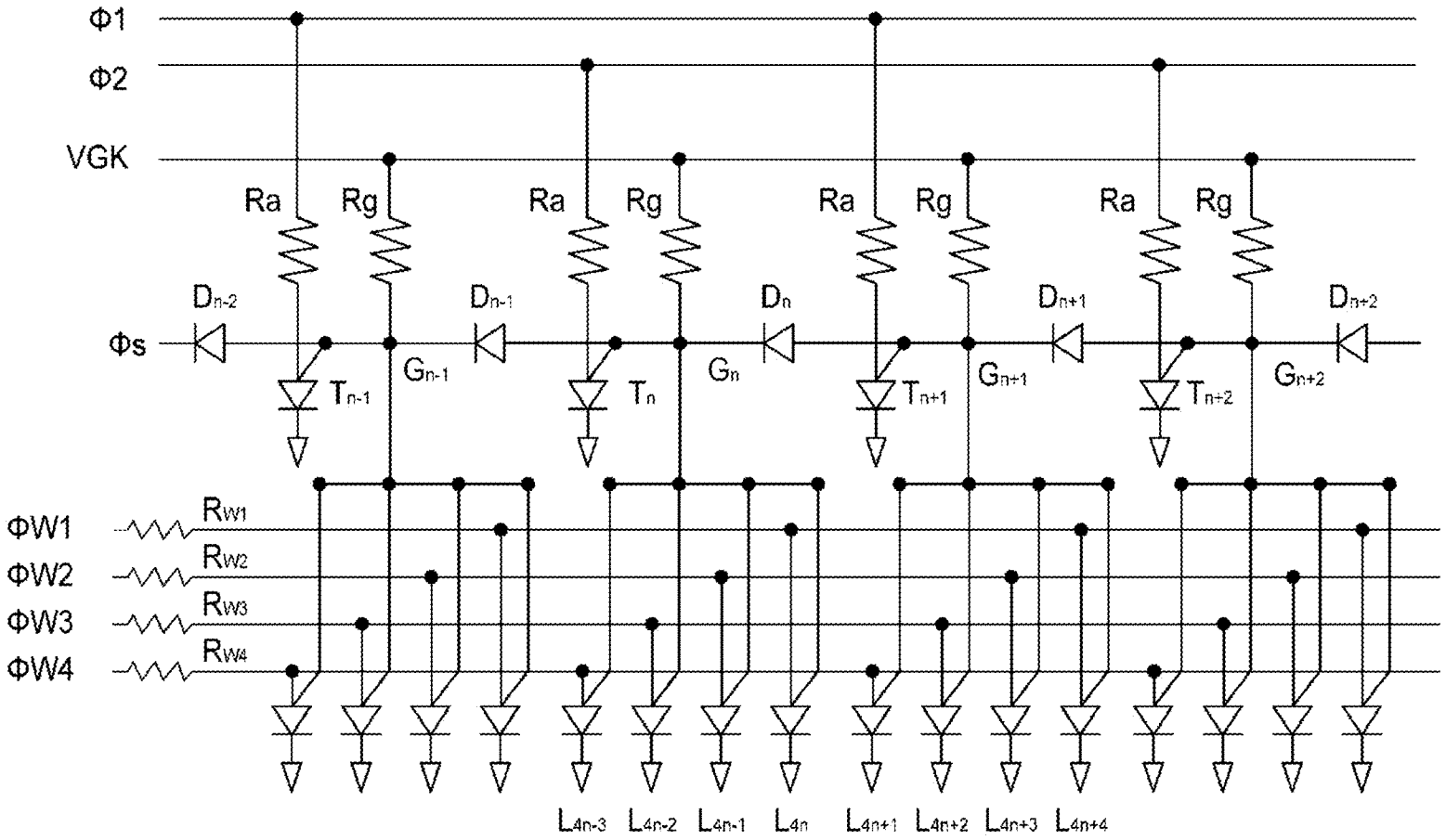

FIG. 7 is a schematic view illustrating a circuit of the surface light emitting element array chip in the embodiments 1 and 2.

Figure 8:
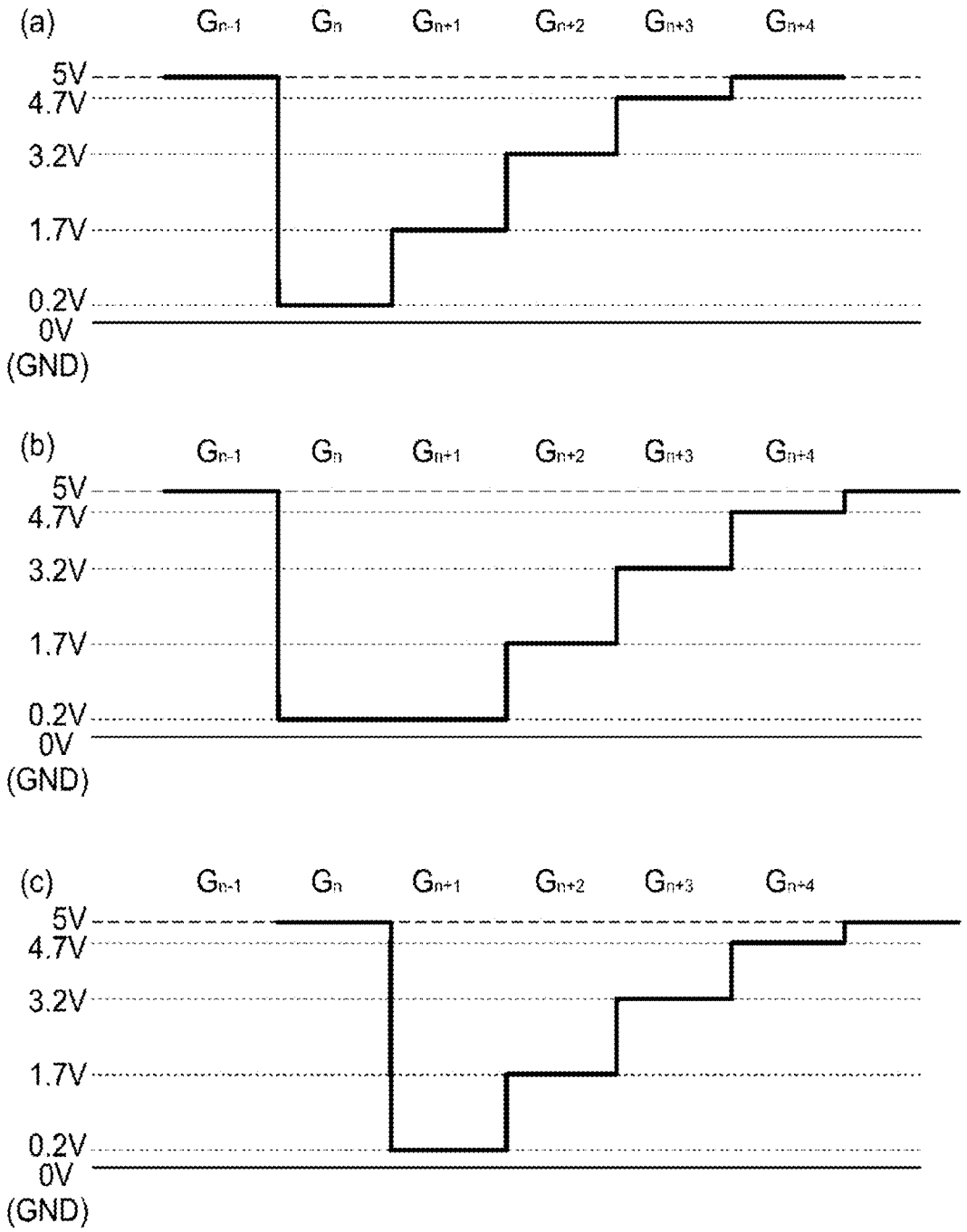

Parts (a), (b) and (c) of FIG. 8 are schematic views illustrating a gate potential distribution of shift thyristors in the embodiments 1 and 2.

Figure 9:
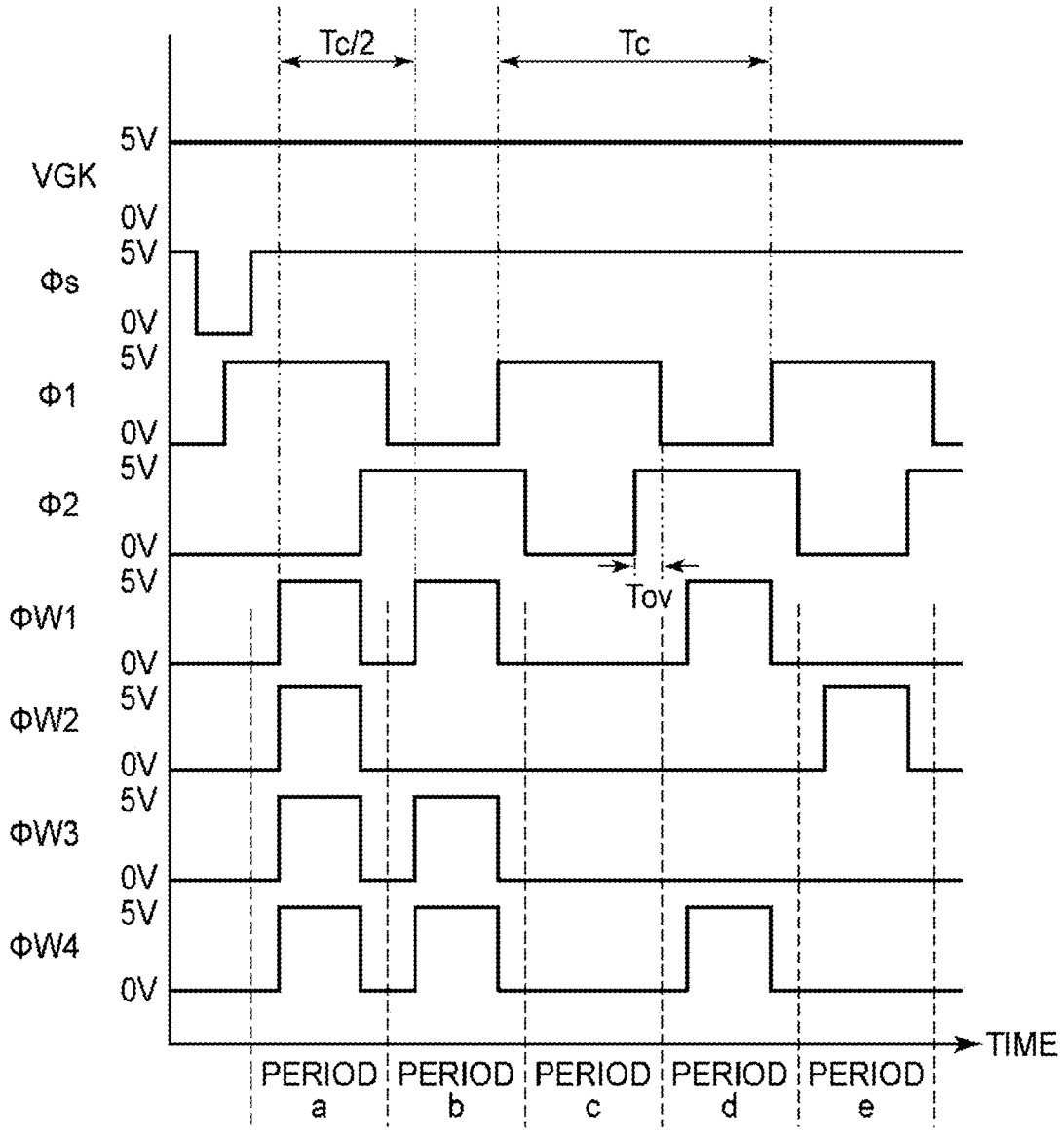

FIG. 9 shows drive signal waveforms of the surface light emitting element array chips in the embodiments 1 and 2.

Figure 10:
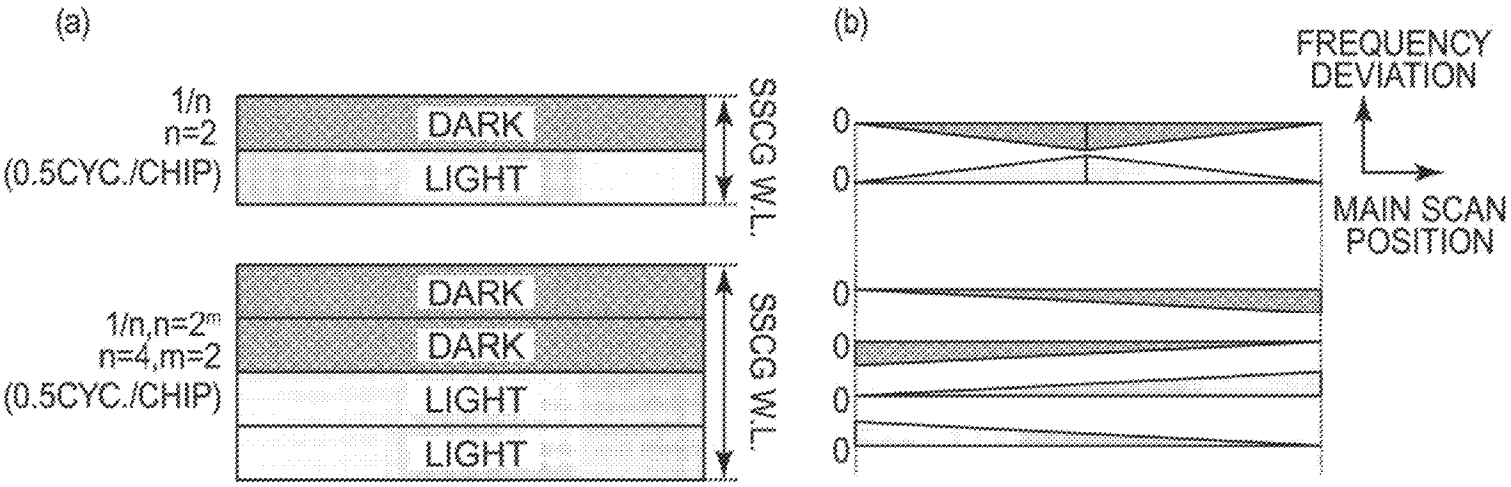

Parts (a) and (b) of FIG. 10 are schematic views illustrating a relationship between surface light emitting element array chips and a modulation cycle (period) of an SSCG in the embodiments 1 and 2.

Figure 11:
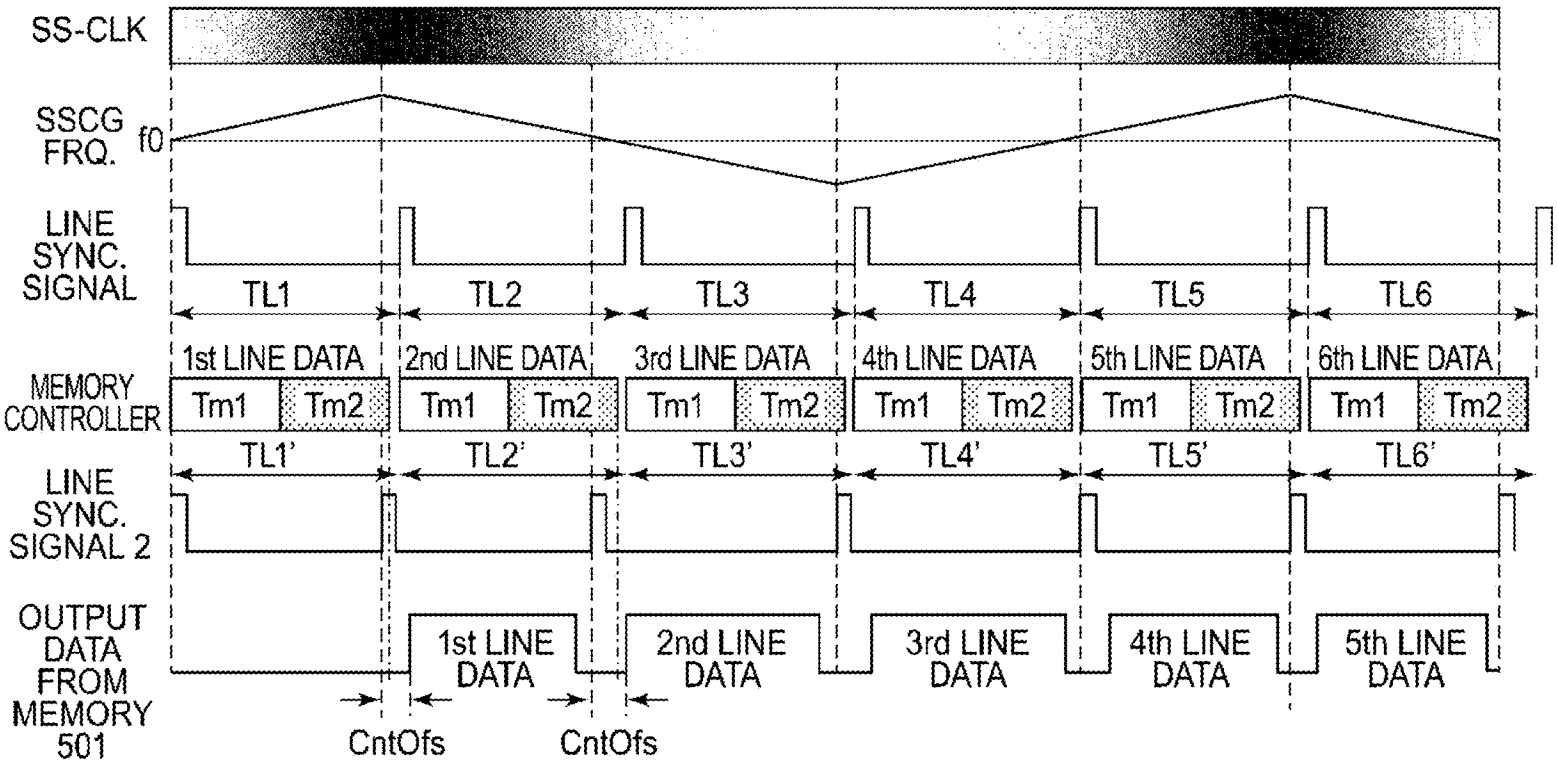

FIG. 11 is a timing chart of the chip data converting portion in the embodiment 2.

Figure 12:
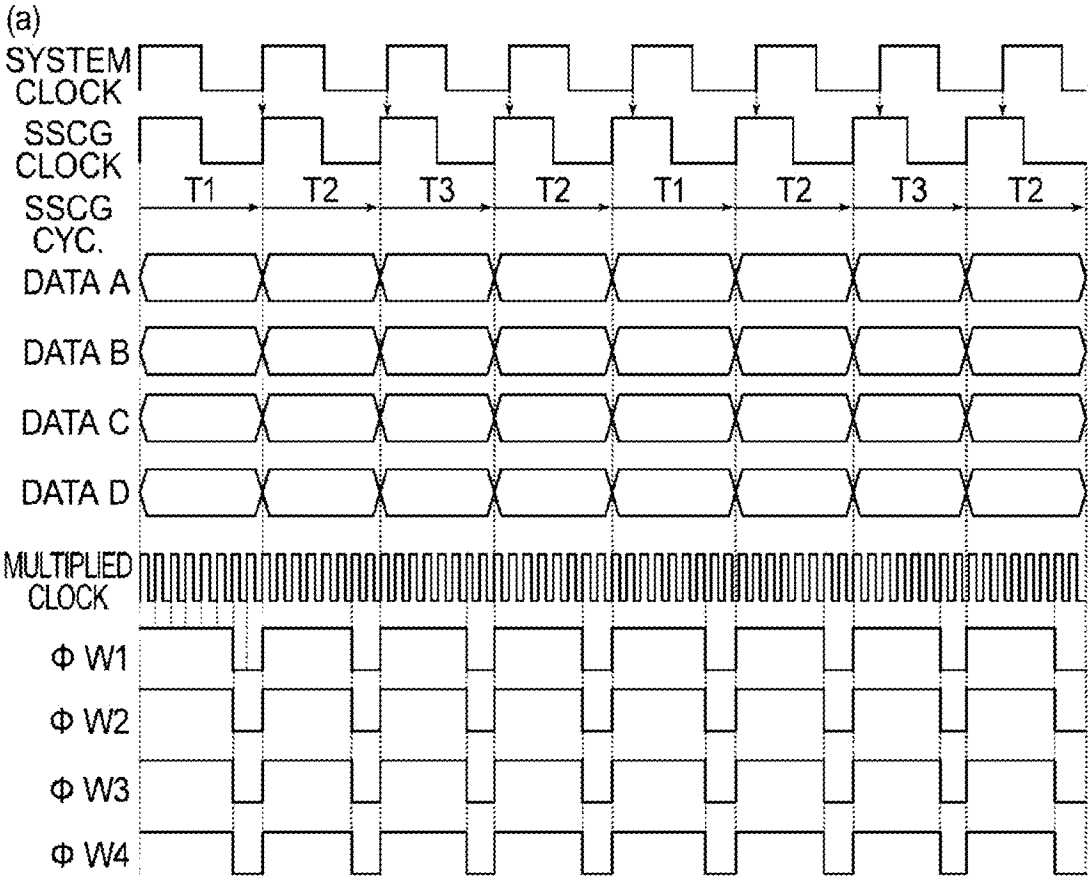

Parts (a) to (d) of FIG. 12 are schematic views illustrating a relationship between modulation of a clock frequency and PWM waveform by the SSCG.

Figure 13:
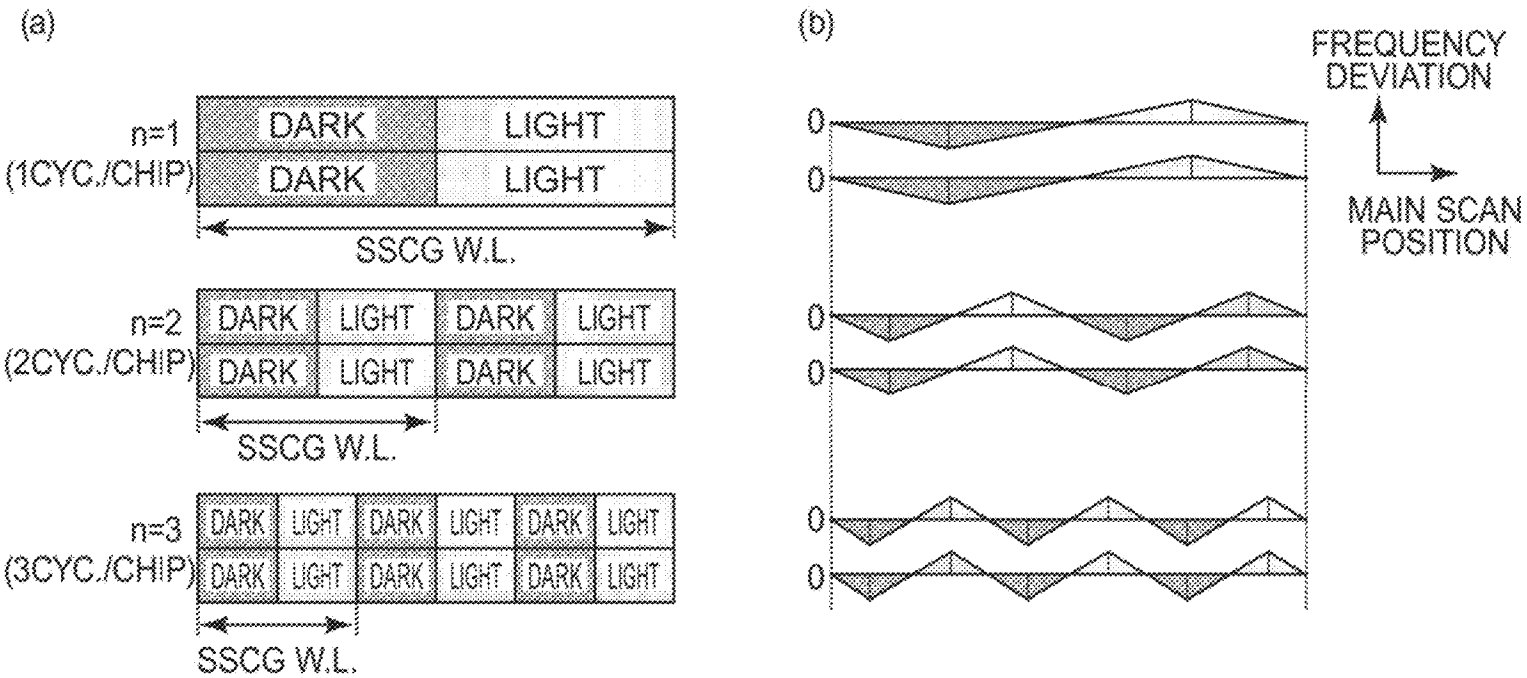

Parts (a) and (b) of FIG. 13 are schematic views illustrating a relationship between surface light emitting element array chips and a modulation cycle (period) of an SSCG.

Figure 14:
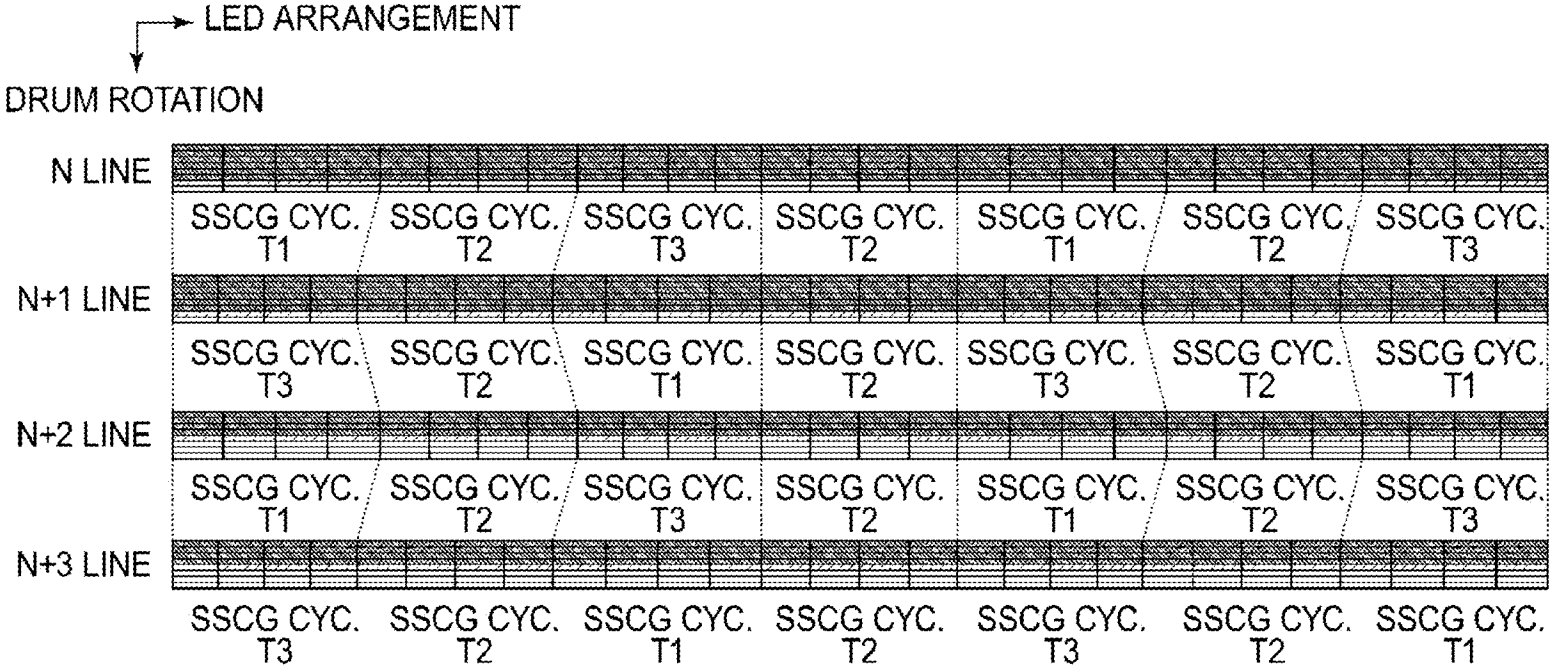

FIG. 14 is a schematic view illustrating a state in which a density fluctuation is canceled.

Figure 15:
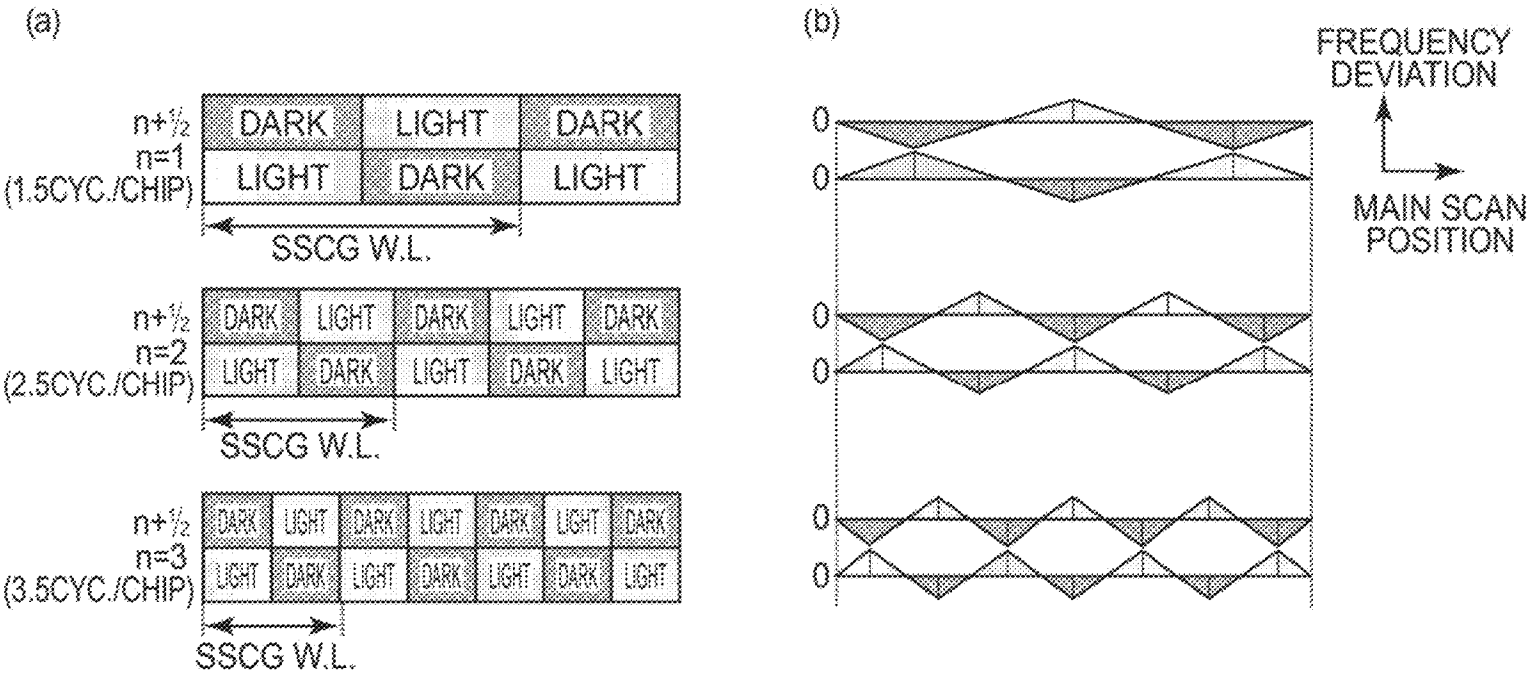

Parts (a) and (b) of FIG. 15 are schematic views illustrating cycle (period) non-uniformity in the case where a length of a surface light emitting element array chip is (integer+½) times CY (period) of the SSCG.

Figure 16:
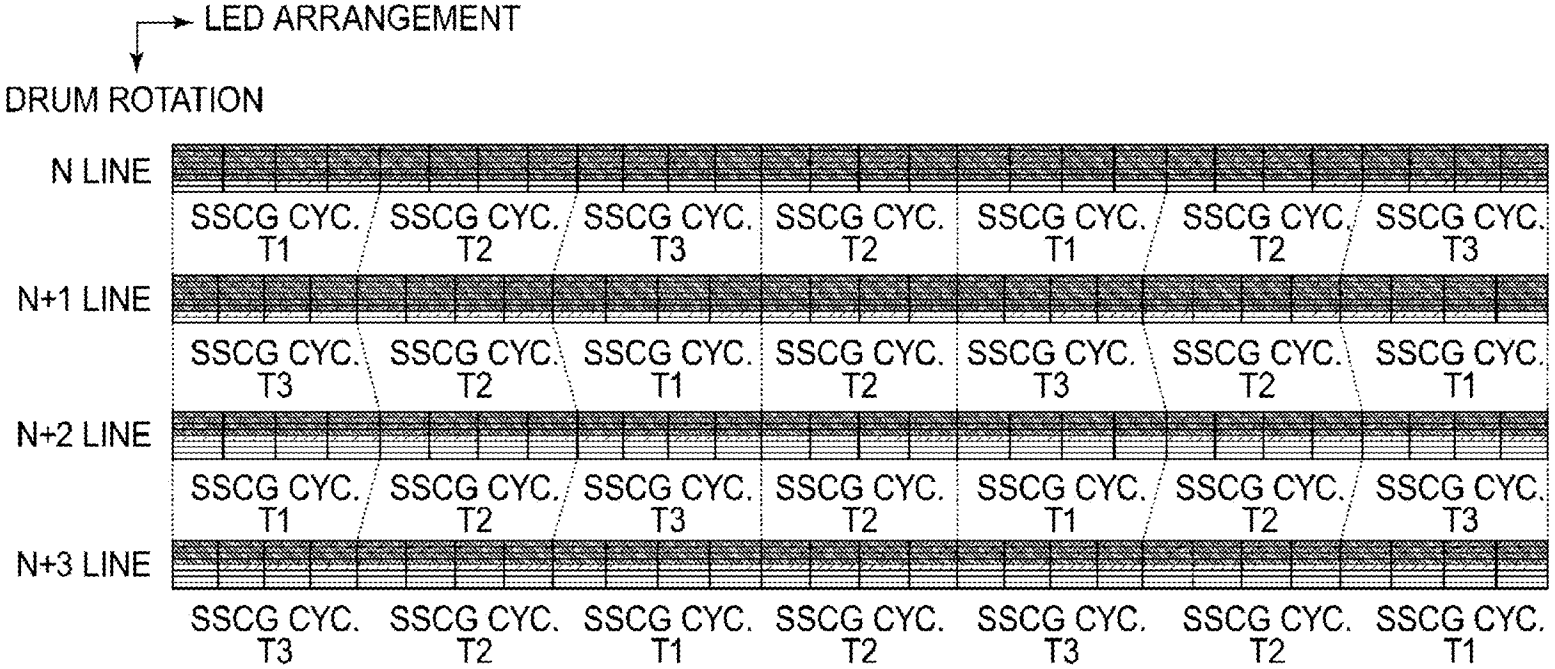

FIG. 16 is a schematic view illustrating a state in which the density fluctuation is not canceled.

Figure 17:
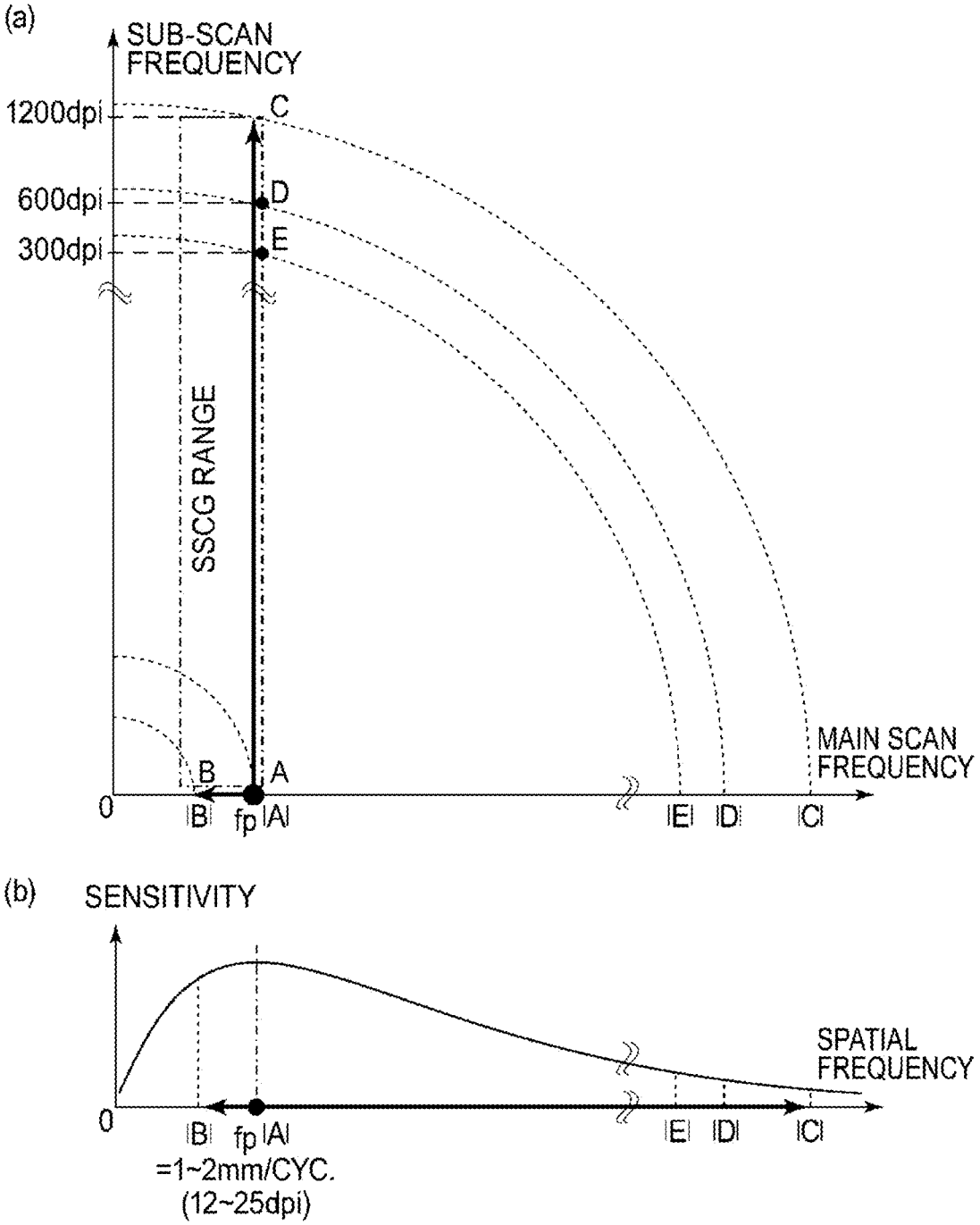

Parts (a) and (b) of FIG. 17 are schematic views illustrating a relationship between the cycle (period) of the SSCG and a spatial frequency of cycle (period) non-uniformity.

DESCRIPTION OF EMBODIMENTS

In the following, embodiments of the present invention will be described in detail with reference to the drawings. In advance of description of embodiments described later, a technique in which a clock frequency used in light emission control is modulated by spectrum spread (diffusion) in order to reduce radiation noise will be described.

The above-described exposure head has the elongated thin shape covering the exposure range with respect to the main scan direction which is the longitudinal direction of the photosensitive drum, in which wiring of the drive signals of the surface light emitting element array chips is made. For that reason, a constitution in which the wiring of the drive signals of the surface light emitting element array chips has a function of an antenna and is liable to constitute a generation source of the radiation noise is formed. As a countermeasure against the radiation noise, there is a method using a spread spectrum clock generator (herein, referred to as SSCG) by which a system clock is modulated and a peak frequency gain as a radiation noise component is suppressed. However, when this method is used in an image forming portion, a cycle (cycle period) of the system clock is fluctuated by increasing or decreasing a clock number, and therefore, there is a liability of a lowering in image quality due to a clock cycle (period) fluctuation.

Part (a) of FIG. 12 is a schematic view illustrating a relationship between the system clock, an SSCG clock, image data, and a PWM waveform of a PWM signal. Part (a) of FIG. 12 shows the system clock which is a basic clock signal, the SSCG clock generated by modulating the system clock, and the SSCG cycle (period) showing one cycle (period) of the SSCG clock in the named order from above. Further, part (a) of FIG. 12 shows data A, data B, data C, data D and multiplied clock obtained by multiplying the SSCG clock (by a factor of 8 in part (a) of FIG. 12) in an ordinate direction. Part (a) of FIG. 12 further shows ΦW1, ΦW2, ΦW3, ΦW4 which are PWM waveforms obtained by converting the data A, the data B, the data C and the data D, respectively, to PWM signals in the ordinate direction. Incidentally, the abscissa of part (a) of FIG. 12 represents time.

For comparing cycles (periods) of the system clock and the SSCG clock with each other, between the two clocks, arrows are indicated. As can be understood from comparison of positions of the arrows with each other, compared with one cycle of the system clock, one cycle of the SSCG clock is short. Further, each of the respective cycles of the SSCG clock is not a certain cycle, and in part (a) of FIG. 12, it is understood that the cycles fluctuate in the order of cycles T1, T2, T3 and T2. A modulation cycle of the SSCG constitutes one unit (period) by at least several tens of clocks in order to spread (diffuse) the frequency. During the period, the cycle of the SSCG clock repeats a cycle fluctuation such that compared with the cycle of the system clock (system clock cycle), the SSCG clock cycle is longer than the system clock cycle, the SSCG clock cycle is shorter than the system clock cycle, the SSCG clock cycle is longer than the system clock cycle, and the SSCG cycle is shorter than the system clock cycle.

The data A, the data B, the data C and the data D which are the image data in part (a) of FIG. 12 are data for generating the PMW signals ΦW1, ΦW2, ΦW3 and ΦW4, respectively. Parts (b), (c) and (d) of FIG. 12 are tables for converting the image data to PWM data (PWM signals). In each of the tables shown in parts (b), (c) and (d) of FIG. 12, "000" to "100" shown in a left-hand column represent the image data ((image) density data), and "PWM data" shown on a right-hand side represents PWM signals corresponding to the image data, respectively. Specifically, "000", "001", "010", "011" and "100" correspond to pixel density values of "0%", "25%", "50%", "75%" and "100%", respectively. In parts (b) to (d) of FIG. 12, each image data is represented by an 8-bit PWM signal, and in each of the figures, "1" means a high level of the PWM signal and "0" means a low level of the PWM signal. Further, in parts (b) to (d) of FIG. 12, the same image data is represented by different PWM signals. For example, the image data "011" is represented by "00111111" in part (b) of FIG. 12, "11111100" in part (c) of FIG. 12, and "01111110" in part (d) of FIG. 12.

All the data A, the data B, the data C and the data D in part (a) of FIG. 12 are "011", and in this embodiment, the image data "011" is converted to the PWM data "11111100" by using the table shown in part (c) of FIG. 12. The PWM data "11111100" is outputted every one bit in synchronism with the multiplied clock, so that the PWM signals ΦW1, ΦW2, ΦW3 and ΦW4 are generated. Incidentally, as shown in part (a) of FIG. 12, a pulse width of each of the PWM signals ΦW1, ΦW2, ΦW3 and ΦW4 is ⅝ time the SSCG cycle.

Next, a relationship between the surface light emitting element array chip and the modulation cycle of the SSCG will be described using the drawings. In the surface light emitting element array chip, the light emitting elements are caused to sequentially emit light toward the photosensitive drum, and the photosensitive drum is scanned with the light emitted from one end light emitting element to the other end light emitting element in the surface light emitting element array chip. When this scanning is ended, exposure scanning is repeated from the one end light emitting element. Parts (a) and (b) of FIG. 13 are schematic views illustrating a relationship between the surface light emitting element array chip and the modulation cycle of the SSCG. Parts (a) and (b) of FIG. 13 show the case where the exposure scanning cycle of the surface light emitting element array chip (this is also referred to as a length of the surface light emitting element array chip) is n (n: positive integer) times the modulation cycle of the SSCG. Incidentally, a direction in which the photosensitive drum rotates is referred to as a sub-scan direction which is a first direction. Further, a direction in which the exposure scanning with the surface light emitting element array chip is carried out is referred to as a main scan direction which is a second direction.

In part (b) of FIG. 13, the abscissa represents a position of the light emitting element in the surface light emitting element array chip, and a region defined by two dotted lines on both sides with respect to the main scan direction shows one surface light emitting element array chip and a range in which the light emitting elements provided inside the one surface light emitting element array chip are disposed. Further, the ordinate represents frequency deviation by the SSCG from a deviation of 0 (in the figure) which is a reference frequency. With 0 as a boundary, a region on a lower side (dark gray portion in the figure) in which the frequency deviation is negative shows a deviation in a direction in which the frequency decreases, and a region on an upper side (light gray portion in the figure) in which the frequency deviation is positive shows a deviation in a direction in which the frequency increases. Further, part (b) of FIG. 13 shows, from an upper graph, a first line and a second line with respect to the sub-scan direction in the case of n=1, a first line and a second line with respect to the sub-scan direction in the case of n=2, and a first line and a second line with respect to the sub-scan direction in the case of n=3. Incidentally, in the case of n=1, one cycle of the exposure scanning with the surface light emitting element array chip and one cycle of the modulation cycle of the SSCG are the same. Similarly, in the case of n=2, two cycles of the modulation cycle of the SSCG and one cycle of the exposure scanning with the surface light emitting element array chip are the same. Similarly, in the case of n=3, three cycles of the modulation cycle of the SSCG and one cycle of the exposure scanning with the surface light emitting element array chip are the same. Incidentally, one cycle of the SSCG is consisting of the former half cycle which is a modulation cycle in which the frequency decreases and the latter half cycle which is a modulation cycle in which the frequency increases.

On the other hand, part (a) of FIG. 13 is a schematic view showing a state of a density fluctuation with the frequency fluctuation by the SSCG in one surface light emitting element array chip in each of the cases of n=1, 2 and 3. Part (a) of FIG. 13 shows, from an upper graph the density fluctuation of the surface light emitting element array chip on a first line and a second line with respect to the sub-scan direction in the case of n=1, the case of n=2 and the case of n=3, and corresponds to the graphs of part (b) of FIG. 13. Incidentally, the abscissa of part (a) of FIG. 13 represents time, and the "SSCG W.L. (wavelength)" shows a length of one cycle of the SSCG. Accordingly, in the cases of n=1, 2 and 3, by the modulation frequency of the SSCG, in the exposure scanning with one surface light emitting element array chip, light and dark images are repeated one time, two times and three times, respectively. In each of the graphs of part (a) of FIG. 13, in the case where the deviation of the modulation frequency of the SSCG is negative, i.e., in the case where the modulation frequency of the SSCG is lower than the reference frequency, the clock cycle becomes long, with the result that the density of the image formed becomes thick ("DARK" indicated in the figure). On the other hand, in the case where the deviation of the modulation frequency of the SSCG is higher than the reference frequency, the clock cycle becomes short, with the result that the density of the image formed becomes thin ("LIGHT" indicated in the figure). Further, the exposure scanning cycle from one end light emitting element to the other end light emitting element in the surface light emitting element array chip is n times (n: integer) the cycle at the modulation frequency of the SSCG, and as shown in part (a) of FIG. 13, the regions with the same density are arranged in the sub-scan direction. For that reason, due to the light and dark density fluctuation, the light and dark cycle non-uniformity with respect to the main scan direction becomes conspicuous. Incidentally, the exposure scanning cycle from the one end light emitting element to the other end light emitting element in the surface light emitting element array chip is also referred to as a length of the surface light emitting element array chip. Further, in the following, the cycle of the modulation frequency of the SSCG is also referred to as an SSCG cycle.

For that reason, for example, in JP-A 2012-245772 and JP-A 2015-229246, a method in which the exposure scanning cycle of one surface light emitting element array chip is set at a cycle which is (n+½) times (n: positive integer) the SSCG cycle, and thus the density fluctuation is canceled, has been proposed. That is, exposure scanning on adjacent lines with respect to the sub-scan direction, by reversing a phase of the modulation frequency of the SSCG by frequency modulation are balanced with each other, so that the light and dark density fluctuation is canceled. FIG. 14 is a schematic view illustrating a state in which the density fluctuation is canceled by setting the exposure scanning cycle of one surface light emitting element array chip at a cycle which is (n+½) times (n: positive integer) the SSCG cycle. FIG. 14 is the schematic view showing a state of formation of pixels (dots) in the case where the surface light emitting element array chip is driven by the PWM signals ΦW1, ΦW2, ΦW3 and ΦW4 generated by converting the image data to the PWM data "11111100" described with reference to part (a) of FIG. 12. Incidentally, details of the PWM signals ΦW1, ΦW2, ΦW3 and ΦW4 will be described later (FIG. 7). FIG. 14 shows a state of formation of pixels on adjacent four lines consisting of N line, (N+1) line, (N+2) line and (N+3) line. In FIG. 14, an ordinate direction represents a drum rotation direction (also the sub-scan direction), and an abscissa direction represents a light emitting element arrangement direction (also the main scan direction) of the surface light emitting element array chip. In FIG. 14, "SSCG CYC. T1", "SSCG CYC. T2" and "SSCG CYC. T3" correspond to T1, T2 and T3, respectively, which are the SSCG cycles shown in part (a) of FIG. 12. In each of the SSCG cycles, four PWM signals are indicated, but represent the PWM signals ΦW1, ΦW2, ΦW3 and ΦW4 from a left side toward a right side. Incidentally, in the PWM signal in each of the SSCG cycles, a hatched (dark gray) region is a portion where the associated light emitting element is turned on and thus the time is deposited, and a white (or light gray) region is a portion where the light emitting element is turned off and thus the time is not deposited.

As regards the adjacent four lines consisting of the N line, the (N+1) line, the (N+2) line and the (N+3) line in FIG. 14, the SSCG cycle is shifted by ½ for each of the lines. That is the SSCG clock cycles are a group of cycles in which the cycles are repeated in the order of the cycle T1, the cycle T2, the cycle T3 and the cycle T2. By this, on the N line, the exposure scanning cycle starts from the cycle T1, but on the (N+1) line, compared with the N line, the SSCG cycle is shifted by ½, so that the exposure scanning cycle starts from the cycle T3. Similarly, on the (N+2) line, the SSCG cycle is shifted by ½ compared with the (N+1) line, so that the exposure scanning cycle starts from the cycle T1, and on the (N+3) line, the SSCG cycle is shifted by ½ compared with the (N+2) line, so that the exposure scanning cycle starts from the cycle T3. For that reason, when the surface light emitting element array chip is viewed microscopically (on one pixel basis), the deviation generates in the light emitting element arrangement direction, but when the surface light emitting element array chip is viewed macroscopically (on plural pixel basis), the deviation does not generate. As a result, even when the SSCG cycle is fluctuated, depending on the spatial frequency, the deviation is not visually recognized.

Parts (a) and (b) of FIG. 15 are schematic views illustrating a relationship between the above-described surface light emitting element array chip and the modulation cycle of the SSCG. Parts (a) and (b) of FIG. 15 show the case where the exposure scanning cycle of the surface light emitting element array chip (this is also referred to as a length of the surface light emitting element array chip) is (n+½) (n: positive integer) times the modulation cycle of the SSCG. In part (b) of FIG. 15, the abscissa represents a position of the light emitting element in the surface light emitting element array chip, and a region defined by two dotted lines on both sides with respect to the main scan direction shows one surface light emitting element array chip and a range in which the light emitting elements provided inside the one surface light emitting element array chip are disposed. Further, the ordinate represents frequency deviation by the SSCG from a deviation of 0 (in the figure) which is a reference frequency. With 0 as a boundary, a region on a lower side (dark gray portion in the figure) in which the frequency deviation is negative shows a deviation in a direction in which the frequency decreases, and a region on an upper side (light gray portion in the figure) in which the frequency deviation is positive shows a deviation in a direction in which the frequency increases. Further, part (b) of FIG. 15 shows, from an upper graph, a first line and a second line with respect to the sub-scan direction in the case of n=1, a first line and a second line with respect to the sub-scan direction in the case of n=2, and a first line and a second line with respect to the sub-scan direction in the case of n=3. On the other hand, part (a) of FIG. 15 is a schematic view showing a state of a density fluctuation with the frequency fluctuation by the SSCG in one surface light emitting element array chip in each of the cases of n=1, 2 and 3. Part (a) of FIG. 15 shows, from an upper graph the density fluctuation of the surface light emitting element array chip on a first line and a second line with respect to the sub-scan direction in the case of n=1, the case of n=2 and the case of n=3, and corresponds to the graphs of part (b) of FIG. 15. As shown in part (a) of FIG. 15, the exposure scanning cycle from one end light emitting element to the other end light emitting element in the surface light emitting element array chip is (N+½) times (n: integer) the cycle at the modulation frequency of the SSCG, the regions increased and decreased in exposure amount alternately are arranged in the sub-scan direction. For that reason, the light and dark cycle non-uniformity with respect to the main scan direction can be made inconspicuous.

However, when a condition in which the exposure scanning cycle of one surface light emitting element array chip is (n+½) times (n: positive integer) of the SSCG cycle is applied to an actual image, the increment and the decrement of the exposure amount cannot be completely canceled, so that the residual component remains in some cases. For example, as shown in FIG. 14, in the case where image density on adjacent lines with respect to the sub-scan direction have the same density, the increment and the decrement of the exposure amount are the same and therefore the density fluctuation is canceled. FIG. 16 is a schematic view illustrating a state of the density fluctuation in the case where the exposure scanning cycle of one surface light emitting element array chip is set at a cycle which is (n+½) times (n: positive integer) of the SSCG cycle and image densities on the adjacent lines with respect to the sub-scan direction are different from each other. In FIG. 16, the N line and the (N+1) line are formed by the PWM signals ΦW1, ΦW2, ΦW3 and ΦW4 generated by converting the image data to the PWM data "11111100" described with reference to part (a) of FIG. 12. Further, the (N+2) line and the (N+3) line are formed by the PWM signals ΦW1, ΦW2, ΦW3 and ΦW4 generated by converting the image data to the PWM data "11110000". Incidentally, FIG. 16 is the schematic view similar to FIG. 14, and description of respective constituent elements will be omitted.

Also in FIG. 16, similarly as in FIG. 14, as regards the adjacent four lines consisting of the N line, the (N+1) line, the (N+2) line and the (N+3) line, the SSCG cycle is shifted by ½ for each of the lines. For that reason, when the surface light emitting element array chip is viewed microscopically (on one pixel basis), the deviation generates in the light emitting element arrangement direction, but when the surface light emitting element array chip is viewed macroscopically (on plural pixel basis), the deviation does not generate. As a result, even when the SSCG cycle is fluctuated, depending on the spatial frequency, the deviation is not visually recognized in some cases. Thus, even when the pixel (image) density (i.e., the PWM signal representing the pixel density) is changed between the N and (N+1) lines and the (N+2) and (N+3) lines, deviation is not visually recognized, but depending on a spatial frequency, the deviation is visually recognized in some cases.

Here, a relationship between the SSCG cycle and the spatial frequency of the cycle non-uniformity will be described using the drawings. Parts (a) and (b) of FIG. 17 are graphs showing the relationship between the SSCG cycle and the spatial frequency of the cycle non-uniformity. In part (a) of FIG. 17, the abscissa represents the spatial frequency with respect to the main scan direction ("MAIN SCAN FREQUENCY" in the figure), and the ordinate represents the spatial frequency with respect to the sub-scan direction ("SUB-SCAN FREQUENCY" in the figure). Further, part (b) of FIG. 17 is the graph showing a visual characteristic of Dooley, in which the abscissa represents the spatial frequency, and the ordinate represents visual sensitivity. The spatial frequency on the abscissa means a higher spatial frequency toward a rightward direction, and the visual sensitivity on the ordinate means higher visual sensitivity toward an upward direction. As a deviation from a reference frequency of the modulation frequency by the SSCG, about 50 clocks are needed. One pixel (one dot) is formed in one clock (cycle) of the SSCG, so that when a resolution with respect to the main scan direction is 1200 dpi, the cycle non-uniformity due to the modulation frequency of the SSCG is 50 (dots)/1200 (dots)×25.4 mm=1.05 mm/cycle. Accordingly, it is understood that an upper limit of the spatial frequency with respect to the main scan direction when the clock cycle is variably changed by the modulation frequency by the SSCG is a spatial frequency fp indicated by a vertical dotted line in part (b) of FIG. 17 and is positioned in the neighborhood of a peak of the visual sensitivity with respect to the main scan direction shown in part (b) of FIG. 17.

Further, in part (a) of FIG. 17, the spatial frequency having the same visual sensitivity with respect to directions other than the main scan direction is indicated by a sector dotted line. Equidistant spatial frequencies from an original (a position of 0 in part (a) of FIG. 17) in part (a) of FIG. 17 have the same visual sensitivity. When the spatial frequency with respect to the sub-scan direction is considered, in the above-described example of FIG. 13 in the case where the exposure scanning cycle of the surface light emitting element array chip is n times (n: positive integer) the SSCG cycle, the density with respect to the sub-scan direction is repeated as the same density ("DARK" and "DARK", or "LIGHT" and "LIGHT"). For that reason, the spatial frequency with respect to the sub-scan direction is 0. On the other hand, in the example of FIG. 15 in the case where the exposure scanning cycle of the surface light emitting element array chip is (n+½) times (n: positive integer), the density with respect to the sub-scan direction is repeated as ("DARK" and "LIGHT"). For that reason, two pixels with respect the sub-scan direction constitute one cycle, so that when the resolution with respect to the sub-scan direction is 2400 dpi, the spatial frequency with respect to the sub-scan direction is 1200 dpi which is ½ of 2400 dpi. When upper and lower limits of the above-described spatial frequency with respect to the sub-scan direction are considered, a range in which the SSCG cycle is variably changed and the cycle non-uniformity of the image density occurs would be considered as a range ("SSCG RANGE" in the figure) enclosed by a chain line indicated in part (a) of FIG. 17.

According to the above-described JP-A 2012-245772 and JP-A 2015-229246, by setting the exposure scanning cycle of the surface light emitting element array chip at a cycle satisfying the condition of (n+½) times (n: positive integer), a main component of the cycle non-uniformity of the image density is moved in an arrow AB direction and thus the cycle non-uniformity is made visually inconspicuous. On the other hand, as regards a residual component of the image density with respect to the main scan direction, a degree of the cycle non-uniformity is small, but is left as a spatial frequency (a black dot portion in part (a) of FIG. 17) which is easily detected visually. The deviation of the modulation frequency of the SSCG is about 50 clocks, and therefore, there is a limit even when the cycle is shortened by modulating the frequency. For that reason, different from the spatial frequency with respect to the sub-scan direction, the residual component cannot be moved in a direction of a high frequency with respect to the main scan direction.

Embodiment 1

[Structure of Image Forming Apparatus]

Figure 1:
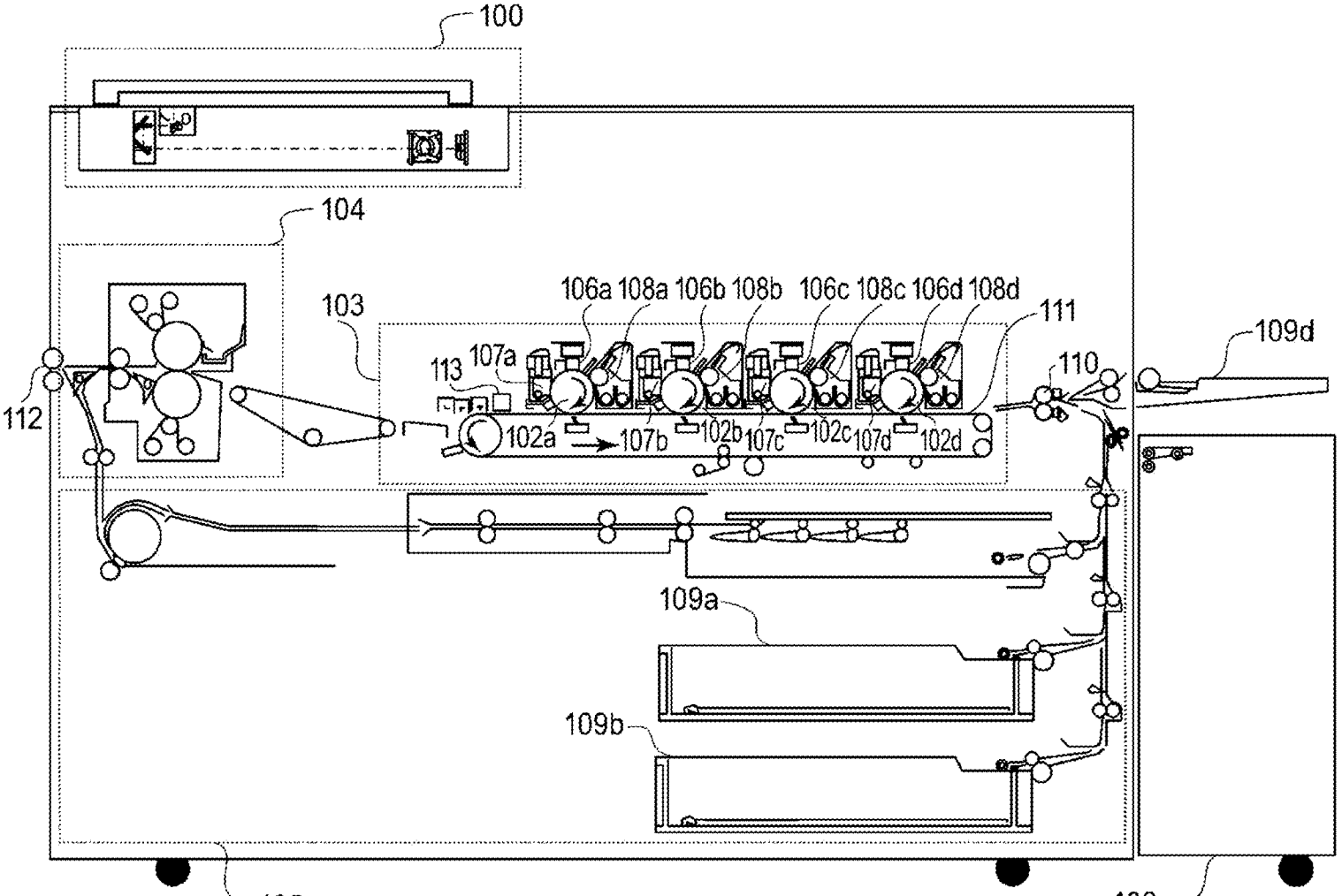
FIG. 1 is a schematic sectional view illustrating a structure of an image forming apparatus of embodiments 1 and 2.

FIG. 1 is a schematic cross-sectional view illustrating a structure of an electrophotographic image forming apparatus according to Embodiment 1. The image forming apparatus shown in FIG. 1 is a multifunction peripheral (MFP) including a scanner function and a printer function, and includes a scanner portion 100, an image forming portion 103, a fixing portion 104, the sheet feeding portion 105, and a printer controller (not shown) for controlling these portions. The scanner portion 100 illuminates an original placed on an original table, optically reads the original image, and converts the read image into an electrical signal to create image data.

The image forming portion 103 includes four image forming stations arranged along the rotational direction (counterclockwise direction) of an endless conveyance belt 111 in the order of cyan (C) image forming station, magenta (M) image forming station, yellow (Y) image forming station, and black (K) image forming station. The four image forming stations have the same structure, and each image forming station includes a photosensitive drum 102 which is a photosensitive member rotatable in a direction of an arrow (clockwise), an exposure head 106, a charging device 107, and a developing device 108. Here, the suffixes a, b, c, and d of the photosensitive drum 102, the exposure head 106, the charging device 107, and the developing portion 108 indicate that they are for black (K) yellow (Y), magenta (M), and cyan (C) image forming stations, respectively. Here, in the following, the suffixes are omitted except when referring to specific photosensitive drum or the like.

In the image forming portion 103, the photosensitive drum 102 is driven to rotate, and the photosensitive drum 102 is charged by the charging device 107. The exposure head 106, which is the exposure portion, emits light from the arranged LED array according to the image data, and the light emitted from a surface of the LED array chip surface is collected on the photosensitive drum 102 (on the photosensitive member) by the rod lens array, so that an electrostatic latent image is formed. The developing device 108 develops the electrostatic latent image formed on the photosensitive drum 102 with toner. And, the toner image obtained by developing the electrostatic latent image is transferred onto a recording sheet (paper) on a conveyance belt 111 which conveys the recording sheet. A series of such electrophotographic processes are executed at each image forming station. Here, during image formation, after a predetermined time has elapsed since image formation at the cyan (C) image forming station is started, image forming operations are executed sequentially at the magenta (M), yellow (Y), and black (K) image forming stations.

The image forming apparatus shown in FIG. 1 is provided with internal sheet feeding units 109*a* and 109*b* included in the sheet feeding portion 105 as units for feeding recording sheets, an external sheet feeding unit 109*c* which is a large capacity sheet feeding unit, and a manual sheet feeding unit 109*d*.

During the image forming operation, recording sheet is fed from a sheet feeding portion designated in advance, and the fed recording sheet is fed to the registration roller 110. The registration roller 110 feeds the recording sheet to the conveyance belt 111 at such a timing that the toner image formed in the image forming portion 103 is transferred onto the recording sheet. The toner images formed on the photosensitive drums 102 of the respective image forming stations are sequentially transferred onto the recording sheet fed by the conveyance belt 111. The recording sheet on which the toner images (unfixed) have been transferred is fed to the fixing portion 104. The fixing portion 104 has a built-in heat source such as a halogen heater, and fixes the toner images on the recording sheet by heating and pressing with two rollers. The recording sheet on which the toner images are fixed by the fixing portion 104 is discharged to the outside of the image forming apparatus by the discharge roller 112.

On the downstream side of the black (K) image forming station in the recording sheet conveyance direction, an optical sensor 113 functioning as a detecting means is disposed at a position facing the conveyance belt 111. The optical sensor 113 detects the position of the test image formed on the conveyance belt 111 to determine the color misregistration amount of the toner image between each image forming station. The amount of color deviation detected by the optical sensor 113 is notified to a control board (substrate) 415 (FIG. 5) which will be described hereinafter, and the image position of each color is corrected so that a full color toner image without color misregistration is transferred onto the recording sheet. In addition, in response to an instruction from the MFP controller (not shown) which controls the entire MFP (MFP), a printer controller (not shown) executes an image forming operation while controlling the above-described scanner portion 100, image forming portion 103, fixing portion 104, sheet feeding portion 105, and the like.

Here, as an example of an electrophotographic image forming apparatus, an image forming apparatus which directly transfers a toner image formed on the photosensitive drum 102 of each image forming station onto a recording sheet on the conveyance belt 111 has been described. The present invention is not limited to a printer which transfers the toner image from the photosensitive drum 102 directly onto the recording sheet. For example, the present invention can also be applied to an image forming apparatus including a primary transfer portion which transfers a toner image from the photosensitive drum 102 onto an intermediary transfer belt and a secondary transfer portion which transfers the toner image from the intermediary transfer belt onto the recording sheet.

[Structure of Exposure Head]

Next, for the exposure head 106 which exposes the photosensitive drum 102 will be explained referring to parts (a) and (b) of FIG. 2. Part (a) of FIG. 2 is a perspective view illustrating a positional relationship between the exposure head 106 and the photosensitive drum 102, and part (b) of FIG. 2 is a view illustrating an internal structure of the exposure head 106 and showing how the light beam from the exposure head 106 is condensed on the photosensitive drum 102 by the rod lens array 203. As shown in part (a) of FIG. 2, the exposure head 106 is mounted to the image forming apparatus by a mounting member (not shown) at a position facing the photosensitive drum 102 rotatable in a direction of an arrow (FIG. 1).

As shown in part (b) of FIG. 2, the exposure head 106 includes a drive substrate 202, a surface (planar) light-emitting-element array element group 201 mounted on the drive substrate 202, a rod lens array 203, and a casing 204. The rod lens array 203 and the drive substrate 202 are mounted to the casing 204. The rod lens array 203 condenses the light flux from the surface light-emitting-element array element group 201 on the photosensitive drum 102. At the factory, the exposure head 106 is assembled and adjusted by itself, and the focus and light intensity of each spot are adjusted. Here, the assembling and adjustment are performed such that a distance between the photosensitive drum 102 and the rod lens array 203 and a distance between the rod lens array 203 and the surface light-emitting-element array element group 201 are predetermined distances. By this, the light from the surface light-emitting-element array element group 201 is imaged on the photosensitive drum 102. Therefore, at the time of focus adjustment at the factory, the mounting position of the rod lens array 203 is adjusted so that the distance between the rod lens array 203 and the surface light-emitting-element array element group 201 is a predetermined value. In addition, when adjusting the light intensity at the factory, each surface light emitting element of the surface light-emitting-element array element group 201 is caused to emit light sequentially, and the drive current of each light emitting element is adjusted so that the light condensed on the photosensitive drum 102 via the rod lens array 203 has a predetermined light intensity.

[Structure of Surface Light-Emitting-Element Array Element Group]

Parts (a), (b) and (c) of FIG. 3 illustrate the surface-light-emitting-element array element group 201. Part (a) of FIG. 3 is a schematic illustration showing the structure of the surface (first surface) on which the surface light-emitting-element array element group 201 of the driving substrate 202 is mounted, part (b) of FIG. 3 is a schematic illustration showing the structure of the surface (second surface) opposite to the first surface on which the light-emitting-element array element group 201 of the drive substrate 202 is mounted.

As shown in part (a) of FIG. 3, the surface emitting element array element group 201 mounted on the driving substrate 202 has a structure in which 29 surface emitting element array chips 1 to 29 are arranged in two rows in a staggered manner along the longitudinal direction of the driving substrate 202. Here, in part (a) of FIG. 3, the vertical direction indicates the first direction, which is the sub-scan (ning) direction (the peripheral moving direction of rotation of the photosensitive drum 102), and the horizontal direction is the second direction, which is the main scan direction (which is also a crossing direction crossing the sub-scan direction) perpendicular to the sub-scan direction. Inside each surface light emitting element array chip, each element of the surface light emitting element array chip including a total of 516 light emitting points is arranged at a predetermined resolution pitch in the longitudinal direction of the surface light emitting element array chip. In this embodiment, the pitch of each element of the surface emitting element array chip is approximately 21.16 μm (≈2.54 cm/1200 dots), which means a resolution of 1200 dpi, and which is the first resolution. As a result, the distance from end to end of 516 light emitting points in one surface light emitting element array chip is about 10.9 mm (∓21.16 μm×516). The light-emitting-element array element group 201 comprises 29 surface light emitting element array chips. The number of surface light emitting elements which can be exposed in the light-emitting-element array element group 201 is 14,964 elements (=516 elements×29 chips), so that image formation corresponding to the image width in the main scanning direction of about 316 mm (≈about 10.9 mm×29 chips) is possible.

Part (c) of FIG. 3 is an illustration showing a state of a boundary portion between the chips of the surface emitting element array chips arranged in two rows in the longitudinal direction, and the horizontal direction is the longitudinal direction of the surface light-emitting-element array element group 201 in part (a) of FIG. 3. As shown in part (c) of FIG. 3, at the end of the surface emitting element array chip, there is provided a wire bonding pad to which a control signal is inputted, and a transfer portion and the light emitting element are driven by the signal fed from the wire bonding pad. In addition, the surface light emitting element array chip has a plurality of light emitting elements. At the boundary between the surface light emitting element array chips, the pitch of the light emitting elements in the longitudinal direction (the distance between the center point of the adjacent two light emitting elements) is approximately 21.16 μm, which is a 1200 dpi resolution pitch. Further, these surface light emitting element array chips arranged in two (upper and lower) rows are placed such that a light emitting point interval (indicated by an arrow S in the figure) of the upper and lower surface emitting element array chips is approx. 84 μm (distance of integer multiple of the resolution, that is, 4 pixels at 1200 dpi, 8 pixels at 2400 dpi).

As shown in part (b) of FIG. 3, drive portions 303*a* and 303*b*, and a connector 305 are mounted on the surface of the drive substrate 202 opposite to the surface on which the surface light-emitting-element array element group 201 is provided. The drivers 303*a* and 303*b* arranged on the respective sides of the connector 305 are driver ICs for driving the surface light emitting element array chips 1 to 15 and the surface light emitting element array chips 16 to 29, respectively. The drive portions 303*a* and 303*b* are connected to the connector 305 via patterns 304*a* and 304*b*, respectively. Connector 305 is connected to signal lines, power supply voltage, and a ground wire for controlling drive portions 303*a* and 303*b* from control substrate (board) 415 (FIG. 4), which will be described hereinafter, thus it is connected to drive portions 303*a* and 303*b*. In addition, from the drive portions 303*a* and 303*b*, a wiring for driving the surface light-emitting-element array element group 201 passes through an inner layer of the driving substrate 202 and is connected to the surface light emitting element array chips 1 to 15 and the surface light emitting element array chips 16 to 29.

[Control Substrate and Drive Substrate Control Structure]

FIG. 4 is a control block diagram of a control substrate 415 which processes image data and outputs the processed data to the drive substrate 202 of the exposure head 106, and of the drive substrate 202 of the exposure head 106 which exposes the photosensitive drum 102 based on the image data inputted from the control substrate 415. As for the drive substrate 202, the surface emitting element array chips 1 to 15 controlled by the driving portion 303*a* shown in FIG. 4 will be described. Here, the surface emitting element array chips 16 to 29 controlled by the driving portion 303*b* (not shown in FIG. 4) also carry out the same operation as the surface emitting element array chips 1 to 15 controlled by the driving portion 303*a*. To simplify the explanation, the explanation will be made as to the image processing for one color here, although in the image forming apparatus of this embodiment, the same processing is carried out simultaneously in four colors. A control substrate 415 shown in FIG. 4 has a connector 416 for transmitting a signal for controlling the exposure head 106 to the drive substrate 202. From the connector 416, the image data, a line synchronizing signal described later and the control signal from the CPU 400 of the control substrate 415 are transmitted, through cables 417, 418 and 419 connected to the connector 305 of the drive substrate 202, respectively.

[Structure of Control Substrate (Board)]

In the control board 415, the CPU 400 principally performs image data processing and print timing processing. The control board 415 includes functional blocks of an image data generating portion 401, a chip data converting portion 403, a chip data shift portion 404, a data sending portion 405, a synchronizing signal generating portion 406, a clock generating portion 421, and an SSCG 422. In the following, processing in each functional block will be described in the order in which image data on the control board 415 is processed.

(Image Data Generating Portion)

The image data generating portion 401 which is a position generating means subjects an input image data, received from a scanner portion 100 or an external computer connected to the image forming apparatus to dithering in a resolution instructed from the CPU 400, and thus generates image data. In this embodiment, the image data generating portion 401 performs the dithering in the resolution of 2400 dpi corresponding to a second resolution.

That is, the image data generated by the image data generating portion 401 is pixel data equivalent to 2400 dpi. The pixel data equivalent to 2400 dpi in this embodiment is 1 bit (data), but one pixel may be expressed by a plurality of bits. The pixel data generated by the image data generating portion 401 is line data corresponding to a line corresponding in 2400 dpi resolution in the sub-scan direction (the rotational direction of the photosensitive drum 102, that is, the conveyance direction of the recording sheet). And, the image data generating portion 401 generates pixel data corresponding to each pixel including a resolution equivalent to 2400 dpi in association with the position of the pixel in the main scan direction (longitudinal direction of the exposure head 106).

(Synchronizing Signal Generating Portion)

The synchronizing signal portion 406 generates a cycle (cyclic) signal which is a signal synchronized with a rotational speed of the photosensitive drum 102 and which corresponds to one line with respect to the rotational direction of the photosensitive drum 102 (hereinafter, this signal is referred to as a line synchronizing signal). The CPU 400 provides an instruction to the synchronizing signal portion 406 to generate the line synchronizing signal in a cycle, i.e., a time of movement of the surface of the photosensitive drum 102 in the rotational direction (sub-scan direction) by a pixel size (about 10.5 μm) of 2400 dpi with respect to the rotational speed of the photosensitive drum 102. For example, in the case where printing is carried out at a speed of 200 mm/sec in the sub-scan direction, the CPU 400 provides an instruction to the synchronizing signal generating portion 406 to generate the line synchronizing signal in a cycle (per (one) line with respect to the sub-scan direction) of about 52.9 μs (≈25.4 mm/2400 dots)/(200 mm)). In the case where the image forming apparatus includes a detecting portion for detecting the rotational speed of the photosensitive drum 102, the CPU 400 calculates the rotational speed of the photosensitive drum 102 on the basis of a detection result (generation cycle of a signal outputted by an encoder) of the detecting portion. Then, the CPU 400 determines the cycle of the line synchronizing signal on the basis of a calculation result. The detecting portion in this embodiment is, for example, an encoder provided on a rotation shaft of the photosensitive drum 102. On the other hand, in the case where the image forming apparatus does not include the detecting portion for detecting the rotational speed of the photosensitive drum 102, the rotational speed of the photosensitive drum 102 is calculated on the basis of the following information. That is, the CPU 400 determines the line synchronizing signal cycle on the basis of information on paper (sheet) kind, such as a basis weight (g/cm$^2$) or a size of the sheet, inputted through an operating portion by a user.

(Chip Data Converting Portion)

The chip data converting portion 403 reads line data line by line with respect to the sub-scan direction by the image data generating portion 401 in synchronism with the line synchronizing signal. Then, the chip data converting portion 403 carries out data processing in which the read line data is divided into line data for each of chips.

Part (a) of FIG. 5 is a block diagram showing a structure of the chip data converting portion 403. In part (a) of FIG. 5, the line synchronizing signal outputted from the synchronizing signal generating portion 406 is inputted to a counter 530. When the line synchronizing signal is inputted, the counter 530 resets a count value to 0 and thereafter increments the count value in synchronism with a pulse number of a CLK (clock) signal (part (a) of FIG. 5). A frequency of the CLK signal generated by the counter 530 is determined in a design stage on the basis of a capacity (bit number) of image data to read in one cycle (period) of the line synchronizing signal by the chip data converting portion 403 and a data processing speed of the chip data converting portion 403 described later. For example, as described above, the surface light-emitting-element array element group 201 includes 14,964 elements (equivalent to 1200 dpi) as the light emitting elements for exposing one line of the photosensitive drum 102 with respect to the sub-scan direction. On the other hand, the image data generating portion 401 performs dithering in a resolution of 2400 dpi. For that reason, the number of pixels of the image data corresponding to one line with respect to the sub-scan direction outputted from the image data generating portion 401 is 29,928 pixels (=14,964×(2400 dpi/1200 dpi). The chip data converting portion 403 reads the line data corresponding to one line with respect to the sub-scan direction in a period of the line synchronizing signal and carries out writing of the line data into a line memory 500 and writing of the image data into memories 501 to 529 described later. For that reason, the counter 530 performs a counting operation of a number (59,856) which is twice the pixel number (29,928) included in the line data corresponding to the one line. The count value of the counter 530 is Tm1 in a period from 1 to 29,928 and is Tm2 in a period from 29,929 to 59,856 (part (b) of FIG. 5).

A READ controller 531 reads the line data from the image data generating portion 401 depending on the count value of the counter 530. That is, the READ controller 531 stores the line data (29,928 pixels) corresponding to the one line with respect to the main scan direction in the period Tm1 in which the count value of the counter 530 increases from 1 to 29,928. Further, a WR controller 532 writes the line data corresponding to the one line with respect to the sub-scan direction stored in the line memory 500 in a division manner into the memories 501 to 529 in the period Tm2 in which the count value of the counter 530 increases from 29,929 to 59,856. Each of the memories 501 to 529 is a memory smaller in storage (memory) capacity than the line memory 500 and stores the line data (divided line data) divided for associated one of the chips. The memories 501 to 529 are FIFO (first in first out) memories provided correspondingly to the surface light emitting element array chips 1 to 29, respectively. That is, the memory 501 stores the line data corresponding to the surface light emitting element array chip 1, the memory 502 stores the line data corresponding to the surface light emitting element array chip 2, . . . and the memory 529 stores the line data corresponding to the surface light emitting element array chip 29.

Then, writing of the line data, read from the image data generating portion 401, into the memories 501 to 529 and output of the image data written in the memories 501 to 529, which are carried out by the chip data converting portion 403 will be described. Part (b) of FIG. 5 is a time chart illustrating input and output timing of the line data in the chip data converting portion 403. In part (b) of FIG. 5, the line synchronizing signal represents a pulse signal outputted from the synchronizing signal generating portion 406. Further, in the figure, each of TL1, TL2, . . . TL10 represents an associated number of a cycle corresponding to one line with respect to the sub-scan direction. Further, one cycle of the line synchronizing signal is divided into the period Tm1 and the period Tm2 depending on the counter value of the counter 530. The input data to the line memory 500 represents the image data from the image data generating portion 401 and is inputted from the image data generating portion 401 in the period Tm1 of each of the cycles TL1, TL2, . . . TL10. One line data in part (b) of FIG. 5 refers to the line data (corresponding to one line with respect to the main scan direction) for a first non-uniformity with respect to the sub-scan direction. Similarly, the line data for a second line, . . . the line data for tenth line refer to the line data (corresponding to one line with respect to the main scan direction) for a second line with respect to the sub-scan direction, . . . the line data (corresponding to one line with respect to the main scan direction) for a tenth line, respectively.

Further, the "input data to memory 501" shown in part (b) of FIG. 5 represents timing when of the line data which are stored in the line memory 500 and each of which corresponds to one line with respect to the main scan direction, the line data corresponding to the surface light emitting element array chip 1 is written in the memory 501. Similarly, the input data to memory 502, the input data to memory 503, . . . the input data to memory 529 represent timings when the line data corresponding to the surface light emitting element array chips 2, 3, . . . 29 are written in the memories 502, 503, . . . 529, respectively. Incidentally, the first line data of the input data to the memory 501 is not all the line data corresponding to one line with respect to the main scan direction, but refers to the line data (divided line data) with respect to the main scan direction to which the surface light emitting element array chip 1 corresponds. This is also true for the input data to the memories 502 to 529.

The "output data from memory 501" shown in part (b) of FIG. 5 represents timing when of the line data written in the line memory 501 is read for being outputted to the surface light emitting element array chip 1. Similarly, the "output data from memory 502", . . . the "output data from memory 529" shown in part (b) of FIG. 5 represent timings when these output data are read for being outputted to the surface light emitting element array chips 2, . . . 29, respectively. Incidentally, the first line data of the output data from the memory 501 is not all the line data corresponding to one line with respect to the main scan direction, but refers to the line data (divided line data) with respect to the main scan direction to which the surface light emitting element array chip 1 corresponds. This is also true for the output data from the memories 502 to 529.

In this embodiment, the line data each corresponding to one line with respect to the main scan direction are sequentially read from the line memory 500, and at first, writing of the line data in the memory 501 for storing the line data of the surface light emitting element array chip 1. Then, writing of the line data in the memory 502 for storing the line data of the surface light emitting element array chip 2, and thereafter, the line data are sequentially and continuously written in from the memory 503 to the memory 529 for storing the line data of the surface light emitting element array chip 29. Incidentally, in the chip data shift portion 404 of a later stage of the chip data converting portion 403, data shift processing with respect to the sub-scan direction is carried out in a surface light emitting element array chip unit. For that reason, in each of the memories 501 to 529, the line data corresponding to 10 lines with respect to the sub-scan direction are stored.

(Chip Data Shift Portion)

The chip data shift portion 404 which is a correcting means carries out the following control. That is, on the basis of data (2400 dpi unit) relating to an image shift amount, with respect to the sub-scan direction, per surface light emitting element array chip designated in advance by the CPU 400, the chip data shift portion 404 controls relative reading timing of the line data from the memories 501 to 529. In the following, image shift processing with respect to the sub-scan direction carried out by the chip data shift portion 404 will be specifically described.

It is desirable that with respect to the longitudinal direction of the exposure head 106, there is no deviation of the mounting positions of even-numbered surface light emitting element array chips. Similarly, it is also desirable that with respect to the longitudinal direction of the exposure head 106, there is no deviation of the mounting positions of odd-numbered surface light emitting element array chips. Further, it is preferable in design that a mounting position relationship between the even-numbered surface light emitting element array chip and the odd-numbered surface light emitting element array chip is a predetermined pixel number (for example, 8 pixels) equivalent to 2400 dpi. Further, a locating position of the light emitting element array with respect to the sub-scan direction in each of the surface light emitting element array chips may preferably be a certain position with no individual difference. However, the mounting position of the surface light emitting element array chip and the locating position of the light emitting element array include errors, and there is a liability that these errors cause a lowering in image quality of an output image.

In a memory 420 shown in FIG. 4, correction data calculated from a relative positional relationship with respect to the sub-scan direction between the respective light emitting element arrays of the surface light emitting element array chips 1 to 29 mounted in a staggered shape on the drive substrate 202 are stored. For example, in the memory 420, correction data based on the following measured data is stored. The correction data indicating that with respect to the surface light emitting element array chip 1 which is a basis of the position with respect to the sub-scan direction, the respective light emitting element arrays of each of the surface light emitting element array chips 2 to 29 are mounted on the drive substrate 202 in a state being shifted in the sub-scan direction by determined pixels on the 2400 dpi basis is stored. The measured data is obtained on the basis of a light receiving result of turning-on of the light emitting elements of the associated surface light emitting element array chip by a measuring device after the surface light emitting element array chips 2 to 29 are mounted on the drive substrate 202. In response to timing-on of a power source switch of the image forming apparatus, the CPU 400 sets the correction data, read from the memory 420, in an inside register of the chip data shift portion 404. On the basis of the correction data set in the inside register, the chip data shift portion 404 performs shift processing of line data for forming the same line stored in the memories 501 to 529. For example, in the case where the light emitting element array of the surface light emitting element array chip 2 is mounted on the drive substrate 202 in a state of being shifted in the sub-scan direction by 8 pixels on the 2400 dpi basis relative to the light emitting element array of the surface light emitting element array chip 1, the chip data shift portion 404 performs the following processing. That is, the chip data shift portion 404 delays output timing of line data, corresponding to the surface light emitting element array chip 2 forming the same line, by a time corresponding to 8 pixels relative to output timing of the line data corresponding to the surface light emitting element array chip 1 to the drive substrate 202. For that reason, the chip data shift portion 404 shifts all the line data corresponding to the surface light emitting element array chip 2 relative to the line data corresponding to the surface light emitting element array chip 1.

(Data Sending Portion)

The data sending portion 405 sends the line data to the drive substrate 202 of the exposure head 106 after the above-described data processing for the series of line data is carried out. With reference to part (b) of FIG. 5 described above, image data sending timing will be described. As shown in part (a) of FIG. 3, of the surface light emitting element array chips, the odd-numbered surface light emitting element array chips 1, 3, 5, . . . 29 are disposed on an upstream side with respect to the sub-scan direction, and the even-numbered surface light emitting element array chips 2, 4, 6, . . . 28 are disposed on a downstream side with respect to the sub-scan direction. In the time chart shown in part (b) of FIG. 5, writing of the image data in the memories 501, . . . 529 corresponding to the odd-numbered surface light emitting element array chips 1, . . . 29 is carried out in the period (TL1 in the figure) of the first line synchronizing signal. Then, in the period (TL2 in the figure) of the subsequent line synchronizing signal, reading of a first line data with respect to the sub-scan direction is carried out from the memories 501, . . . 529 corresponding to the odd-numbered surface light emitting element array chips 1, . . . 29. Similarly, in a period of a further subsequent line synchronizing signal, reading of a second line data with respect to the sub-scan direction is carried out from the memories 501, . . . 529 corresponding to the odd-numbered surface light emitting element array chips 1, . . . 29. Then, in the period (TL10 in the figure) of the tenth line synchronizing signal, reading of a ninth line data with respect to the sub-scan direction is carried out from the memories 501, . . . 529 corresponding to the odd-numbered surface light emitting element array chips 1, . . . 29. Further, as regards the memory 502 corresponding to the even-numbered surface light emitting element array chip 2, reading of the image data from the memory 502 is carried out in the period (TL10 in the figure) after 9 pulses of the line synchronizing signal from the period TL1 in which the writing of the image data in the memory 502 is carried out.

The data sending portion 405 sends, to the drive substrate 202, the line data processed by the chip data shift portion 404. In this embodiment, a frequency of a clock signal ("CLK" in part (b) of FIG. 5) so that the count value is not less than 59,856 (the number which is twice the number of the image data of one line) in one cycle of the line synchronizing signal is determined. By this, in one cycle of the line synchronizing signal, it becomes possible to carry out input (writing) of the image data into the line memory 500 and output (reading) of the image data from the line memory 500 to the memories 501 to 529.

On the other hand, reading of the data from the memories 501 to 529 is made by parallelly outputting the image data corresponding to one line with respect to the sub-scan direction corresponding to each surface light emitting element array chip from 29 memories 501 to 529 within one cycle of the line synchronizing signal. For that reason, a reading speed of the image data from the memories 501 to 529 may also be lower than a writing speed of the image data into the memories 501 to 529. For example, in this embodiment, the image data is read from the memories 501 to 529 in a cycle which is 58 times the cycle of the clock signal during the writing of the image data into the memories 501 to 529.

(Clock Generating Portion and SSCG)

In the control substrate 415, the clock generating portion 421 generates the clock signal CLK which is a reference clock signal for controlling light emission timing. The SSCG 422 which is the spread spectrum clock generator generates a modulation clock signal SS-CLK subjected to spectrum spread (diffusion), on the basis of the clock signal CLK inputted from the clock generating portion 421. Further, the CPU 400 sets a cycle and strength of the modulation clock signal SS-CLK for the SSCG 422. In this embodiment, the cycle of the modulation clock signal SS-CLK is set at a cycle which is twice the exposure cycle of one surface light emitting element array chip. The strength of the modulation clock signal SS-CLK is settable in a range of 0.1% to 5%, and is set at a small value in a range in which radiation noise of the main assembly of the image forming apparatus is sufficiently reduced. To the image data generating portion 401 and the CPU 400, the clock signal CLK is supplied from the clock generating portion 421. On the other hand, to the chip data shift portion 404, the modulation clock signal SS-CLK is supplied from the SSCG 422. Further, to the chip data converting portion 403 and the synchronizing signal generating portion 406, the clock signal CLK and the modulation clock signal SS-CLK are supplied from the clock generating portion 421 and the SSCG 422, respectively. The synchronizing signal generating portion 406 generates the line synchronizing signal on the basis of the clock signal CLK and generates a line synchronizing signal 2 described later on the basis of the modulation clock signal SS-CLK.

In the chip data converting portion 403, writing and reading of the line memory 500 and writing of the memories 501 to 529 are carried out using the clock signal CLK. On the other hand, reading of the memories 501 to 529 is carried out using the modulation clock signal SS-CLK. FIG. 6 is a schematic view illustrating a state thereof. In the figure, the ordinate represents the modulation clock signal SS-CLK, the SSCG frequency, the line synchronizing signal, memory control, the line synchronizing signal 2 and the output data from the memory 501 in the order from above. The modulation clock signal SS-CLK shows a state of the clock signal supplied from the SSCG 422, and shows a high-frequency portion in a dark (thick) state and a low-frequency portion in a light (thin) state. In this embodiment, a cycle of a modulation frequency of the modulation clock signal SS-CLK corresponds to twice the line synchronizing signal, i.e., corresponds to an exposure cycle of two line data. Incidentally, an enlarged view of a portion enclosed by an elliptical dotted line shows a signal waveform of the SS-CLK. Further, the SSCG frequency is a plot of a level of a frequency modulated on the basis of a reference frequency ID, and an upward direction in the figure is a frequency increasing direction and a downward direction in the figure is a frequency decreasing direction.

The line synchronizing signal is a pulse signal outputted from the synchronizing signal generating portion 406 and shows timing when the memory control of the data of each line is started. Further, in the figure, TL1, TL2, TL3 and TL4 represent the numbers of cycles each corresponding to one line with respect to the sub-scan direction. The memory control shows first line data, second line data, third line data and fourth line data read and written in the cycles TL1, TL2, TL3 and TL4, respectively, in synchronism with the line synchronizing signal. Incidentally, a period Tm1 is a period in which the image data from the image data generating portion 401 is written in the line memory 500, and a period Tm2 is a period in which the image data is written from the line memory 500 in the memories 501 to 529. The line synchronizing signal 2 is a pulse signal which is outputted from the synchronizing signal generating portion 406 and which is synchronized with the modulation clock signal SS-CLK, and shows timing when the chip data shift portion 404 reads the image data from the memories 501 to 529. In this embodiment, the cycle of the clock signal CLK which is a reference signal and the cycle of the modulation clock signal SS-CLK are different from each other. For that reason, the synchronizing signal generating portion 406 generates and outputs the line synchronizing signal corresponding to the clock signal CLK showing timing in which the image data corresponding to one line is controlled, and the line synchronizing signal 2 corresponding to the modulation clock signal SS-CLK.

The writing of the image data in the memories 501 to 529 is carried out by the clock signal CLK based on the line synchronizing signal. On the other hand, reading of the image data from the memories 501 to 529 is carried out by the modulation clock signal SS-CLK based on the line synchronizing signal 2. For that reason, compared with the cycles (TL1 to TL4) of the line synchronizing signal, in a period in which the SSCG frequency is high, cycles (TL1', TL3') of the line synchronizing signal 2 are short, and in a period in which the SSCG frequency is low, cycles (TL2', TL4') of the line synchronizing signal 2 are long. In the states Tm1 and Tm2 synchronized with the line synchronizing signal and in the output data which is synchronized with the line synchronizing signal 2 which is outputted from the memories 501 to 529 to the chip data shift portion 404, timing of writing/reading fluctuates. In this embodiment, an offset period in which output timing of the data from the memories 501 to 529 to the chip data shift portion 404 is offset on the basis of the line synchronizing signal 2 by a period CntOfs is provided. By providing the offset period CntOfs, it is possible to carry out control so that a writing period in the memories 501 to 529 and a reading period from the memories 501 to 529 do not overlap with each other.

[Structure of Drive Substrate of Exposure Head]

(Data Receiver)

Next, the processing inside the drive portion 303*a* mounted on the drive substrate 202 of the exposure head 106 will be described.

The drive portion 303*a* mounted on the drive substrate 202 includes functional blocks of a data receiving portion (receiver) 407, a filter processing portion 408, an LUT 410, a PWM signal generation portion 411, a timing controller 412, a control signal generation portion 413, and a drive voltage generation portion 414. In the following, the processing of each functional block will be described in the order in which image data is processed by the drive portion 303*a*. Here, as described above, in the chip data converting portion 403, image data for each of the 29 surface light emitting element array chips are arranged, and the subsequent processing blocks are constituted to process each image data stored in the 29 chips in parallel. The driving portion 303*a* includes a circuit which receives image data corresponding to the surface light emitting element array chips 1 to 15 and can process each surface light emitting element array chip in parallel.

(Data Receiver)

The data receiving portion 407 receives a signal transmitted from the data sending (transmitting) portion 405. Here, the data receiving portion 407 and the data sending portion 405 receive and send (transmit) image data (line data) in a line unit with respect to the sub-scan direction in synchronization with the line synchronizing signal 2.

(Filter Processing Portion)

The filter processing portion 408 which is a converting means performs interpolation processing by filter processing, with respect to the main scan direction, of the image data for each of the surface light emitting element array chips, and converts resolution with respect to the main scan direction from 2400 dpi to 1200 dpi. Specifically, processing from the image data generating portion 401 of the control substrate 415 to the data receiving portion 407 of the exposure head 106 is performed at 2400 dpi in image position movement in the main scan direction, and the filter processing portion 408 in the later stage converts the resolution of the image data to 1200 dpi. By this, in a state in which image movement accuracy in 2400 dpi unit is maintained, the image of 1200 dpi can be formed.

(LUT)

The subsequent LUT 410 performs data conversion of an image data value (density data value) for each pixel corresponding to the associated surface light emitting element array chip with reference to a look-up table. On the basis of a response characteristic of a light emission time of the surface light emitting element array chip, the LUT 410 performs the conversion of the data value for each pixel so that an integrated light quantity when pulse light emission is carried out is a predetermined value. For example, in the case where the responsivity of the light emission time of the surface light emitting element array chip is slow and the integrated light quantity is smaller than a target value, the data conversion is carried out so that the data value increases. In this embodiment, before the image formation is started, the CPU 400 sets a value of a conversion table, set in the look-up table, at a predetermined value based on a light emitting element array response characteristic which is empirically obtained.

(PWM Signal Generating Portion, Timing Controller, Control Signal Generating Portion, Drive Voltage Generating Portion)

The PWM signal generating portion 411 generates a pulse width signal (hereinafter referred to as the PWM (pulse width modulation signal) provided corresponding to the light emission time performed in one pixel portion by the surface light emitting element array chip in accordance with the data value for each pixel. The timing for outputting the PWM signal is controlled by the timing controller 412. The timing controller 412 generates a synchronization signal corresponding to the pixel section of each pixel from the line synchronizing signal 2 generated by the synchronizing signal generating portion 406 of the control substrate 415, and outputs the synchronization signal to the PWM signal generating portion 411. The drive voltage generating portion 414 generates a drive voltage for driving the surface light emitting element array chip in synchronization with the PWM signal. Here, the drive voltage generating portion 414 has a structure in which the voltage level of the output signal can be adjusted around 5V so that the CPU 400 provides a predetermined light quantity (intensity). In this embodiment, each surface light emitting element array chip is constituted such that four light emitting elements can be driven independently from each other at the same time. Accordingly, in the exposure head 106, in the case where exposure scanning of the photosensitive drum 102 is carried out, light emission control of the four light emitting elements is carried out at the same time in each of the surface light emitting element array chips 1 to 29. For that reason, when the light emission control of all the light emitting elements of one surface light emitting element array chip is ended, exposure scanning for one line of the photosensitive drum 102 with respect to the main scan direction by the exposure head 106 is ended. The drive voltage generating portion 414 supplies drive signals to 4 lines of drive signal for each surface light emitting element array chip, that is, for the entire exposure head 106, supplies drive signals to staggered 1 line ((15 chips)×4=60 lines). Drive signals supplied to each light emitting element array chip are ΦW1 to ΦW4 (FIG. 7). On the other hand, the surface light emitting element chip array is sequentially driven by the operation of a shift thyristor (FIG. 7) which will be described hereinafter. The control signal generation portion 413 generates control signals Φs, Φ1, and Φ2 for transferring the shift thyristor for each pixel from the synchronization signal corresponding to the pixel portion generated by the timing controller 412 (FIG. 7).

[SLED circuit]

FIG. 7 is an equivalent circuit in which a part of the self-scanning LED (SLED) chip array of this embodiment is extracted. In FIG. 7, Ra and Rg are anode resistance and gate resistance, respectively, Tn is a shift thyristor, Dn is a transfer diode, and Ln is a light emitting thyristor. In addition, Gn depicts a common gate of the corresponding shift thyristor Tn and the light emitting thyristor Ln connected to the shift thyristor Tn. Here, n is an integer of 2 or more. Φ1 is a transfer line of an odd-numbered shift thyristor T, and Φ2 is a transfer line of an even-numbered shift thyristor T. ΦW1 to ΦW4 are lighting signal lines for the light-emitting thyristor L, and are connected to resistors RW1 to RW4, respectively. VGK is a gate line, and Φs is a start pulse line. As shown in FIG. 7, four light emitting thyristors L4*n*−3 to L4*n* are connected to one shift thyristor Tn, and the four light emitting thyristors L4*n*−3 to L4*n* can be turned on simultaneously.

[Operation of SLED circuit]

The operation of the SLED circuit shown in FIG. 7 will be described. Here, in the circuit illustration of FIG. 7, it is assumed that 5V is applied to the gate line VGK, and the voltages inputted to the transfer lines Φ1, Φ2 and the lighting signal lines ΦW1 to ΦW4 are also 5V. In FIG. 7, when the shift thyristor Tn is on, the potential of the common gate Gn of the light-emitting thyristor Ln connected to the shift thyristor Tn and the shift thyristor Tn is lowered to about 0.2V. The common gate Gn of the light emitting thyristor Ln and the common gate Gn+1 of the light emitting thyristor Ln+1 are connected by a coupling diode Dn, and therefore, a potential difference substantially equal to the diffusion potential of the coupling diode Dn is generated. In this embodiment, the diffusion potential of the coupling diode Dn is about 1.5V, and therefore, the potential of the common gate Gn+1 of the light emitting thyristor Ln+1 is 1.7V (=0.2V+1.5V) obtained by adding 1.5V of the diffusion potential to 0.2V of the potential of the common gate Gn of the light emitting thyristor Ln. Similarly, the potential of the common gate Gn+2 of the light emitting thyristor Ln+2 is 3.2V (=1.7V+1.5V), and the potential of the common gate Gn+3 (not shown) of the light emitting thyristor Ln+3 (not shown) is 4.7V (=3.2V+1.5V) However, the potential after the common gate Gn+4 of the light-emitting thyristor Ln+4 is 5V because the voltage of the gate line VGK is not higher than this, and therefore, it is 5V. In addition, as to the potential of the common gate Gn−1 before the common gate Gn of the light emitting thyristor Ln (left side of the common gate Gn in FIG. 7), the coupling diode Dn−1 is reverse biased, and therefore, the voltage of the gate line VGK is applied as it is, and it is 5V.

Part (a) of FIG. 8 is an illustration showing the distribution of the gate potential of the common gate Gn of each light-emitting thyristor Ln when the above-described shift thyristor Tn is in the on state, in which the common gates Gn−1, Gn, Gn+1, and so on depict the common gates of the light emitting thyristors L in FIG. 7. In addition, the vertical axis of part (a) in FIG. 8 indicates the gate potential. The voltage required to turn on each shift thyristor Tn (hereinafter referred to as the threshold voltage) is substantially the same as the gate potential of the common gate Gn of each light-emitting thyristor Ln plus the diffusion potential (1.5V). When the shift thyristor Tn is on, the shift thyristor Tn+2 has the lowest gate potential of the common gate among the shift thyristors connected to the transfer line Φ2 of the same shift thyristor Tn. The potential of the common gate Gn+2 of the light emitting thyristor Ln+2 connected to the shift thyristor Tn+2 is 3.2V (=1.7V+1.5V) (part (a) of FIG. 8) as described above. Therefore, the threshold voltage of the shift thyristor Tn+2 is 4.7V (=3.2V+1.5V) However, shift thyristor Tn is on, and therefore, the potential of transfer line Φ2 is drawn to about 1.5V (diffusion potential), and it is lower than the threshold voltage of shift thyristor Tn+2, so that shift thyristor Tn+2 cannot be turned on. Other shift thyristors connected to the same transfer line Φ2 have a higher threshold voltage than the shift thyristor Tn+2, and therefore, it cannot be turned on, either, and only the shift thyristor Tn can be kept on.

In addition, for shift thyristors connected to transfer line Φ1, the threshold voltage of the shift thyristor Tn+1 where the threshold voltage is the lowest is 3.2V (=1.7V+1.5V). Next, the shift thyristor Tn+3 (not shown in FIG. 7) having the lowest threshold voltage is 6.2V (=4.7V+1.5V). In this state, when 5V is inputted to the transfer line Φ1, only the shift thyristor Tn+1 can be turned on. In this state, the shift thyristor Tn and the shift thyristor Tn+1 are in the on-state simultaneously. Therefore, gate potentials of shift thyristors Tn+2, Tn+3, and so on provided on the right side of the shift thyristor Tn+1 in the circuit shown in FIG. 7 are lowered by the amount corresponding to the diffusion potential (1.5V). However, the voltage of the gate line VGK is 5V, and the common gate voltage of the light emitting thyristor L is limited by the voltage of the gate line VGK, and therefore, the gate potential on the right side of the shift thyristor Tn+5 is 5V. Part (b) of FIG. 8 shows the gate voltage distribution of each of the common gates Gn−1 to Gn+4 at this time, in which the vertical axis represents the gate potential. In this state, when the potential of the transfer line Φ2 is lowered to 0V, the shift thyristor Tn is turned off, and the potential of the common gate Gn of the shift thyristor Tn is increased to the VGK potential. Part (c) of FIG. 8 is an illustration showing the gate voltage distribution at this time, in which the vertical axis shows the gate potential. In this manner, the on-state transfer from the shift thyristor Tn to the shift thyristor Tn+1 is completed.

[Light emission operation of light emitting thyristor]

Next, a light emitting operation of the light emitting thyristor will be described. When only the shift thyristor Tn is on, the gates of the four light emitting thyristors L4*n*−3 to L4*n* are connected in common to the common gate Gn of the shift thyristor Tn. Therefore, the gate potentials of the light emitting thyristors L4*n*−3 to L4*n* are 0.2V, which is the same as that of the common gate Gn. Therefore, the threshold value of each light emitting thyristor is 1.7V (=0.2V+1.5V), and if a voltage of 1.7V or more is inputted from the lighting signal lines ΦW1 to ΦW4 of the light emitting thyristors, the light emitting thyristors L4*n*−3 to L4*n* can be turned on. Therefore, by inputting a lighting signal to the lighting signal lines ΦW1 to ΦW4 when the shift thyristor Tn is on, the four light emitting thyristors L4*n*−3 to L4*n* can selectively emit light. At this time, the potential of the common gate Gn+1 of the shift thyristor Tn+1 next to the shift thyristor Tn is 1.7V, and the threshold voltage of the light emitting thyristors L4*n*+1 to 4*n*+4 connected to the common gate Gn+1 is 3.2V (=1.7V+1.5V) The lighting signal inputted from lighting signal lines ΦW1 to ΦW4 is 5V, and therefore, the light-emitting thyristors L4*n*+1 to L4*n*+4 are likely to light up with the same lighting pattern as the light-emitting thyristors L4*n*−3 to 4*n*. However, the threshold voltage is lower in the light emitting thyristors L4*n*−3 to L4*n*, and therefore, when a lighting signal is inputted through the lighting signal lines ΦW1 to ΦW4, they turn on earlier than light-emitting thyristors L4*n*+1 to L4*n*+4. Once the light emitting thyristors L4*n*−3 to L4*n* are turned on, the connected lighting signal lines ΦW1 to ΦW4 are lowered to about 1.5V (diffusion potential). Therefore, the potential of the lighting signal lines ΦW1 to ΦW4 becomes lower than the threshold voltage of the light emitting thyristors L4*n*+1 to L4*n*+4, and therefore, the light emitting thyristors L4*n*+1 to L4*n*+4 cannot be turned on. As described above, by connecting the multiple light-emitting thyristors L to one shift thyristor T, the plurality of light-emitting thyristors L can be turned on simultaneously.

FIG. 9 is a timing chart of the drive signals for the SLED circuit shown in FIG. 7. FIG. 9 shows the voltage waveforms of the drive signals for the gate line VGK, the start pulse line Φs, the odd-numbered and even-numbered shift thyristor transfer lines Φ1, Φ2, and the light-emitting thyristor lighting signal lines ΦW1-ΦW4, in this order from top to bottom. Here, each drive signal has an on-state voltage of 5V and an off-state voltage of 0V. In addition, the abscissa (horizontal axis) in FIG. 9 indicates time. In addition, Tc indicates the cycle (period) of the clock signal Φ1, and Tc/2 indicates a cycle that is half (=½) of the cycle Tc.

The voltage of 5V is always applied to the gate line VGK. In addition, the clock signal Φ1 for the odd-numbered shift thyristor and the clock signal Φ2 for the even-numbered shift thyristor are inputted at the same cycle Tc, and 5V is supplied as the signal Φs for the start pulse line. To make a potential difference on the gate line VGK shortly before the clock signal Φ1 for the odd-numbered shift thyristor first becomes 5V, the signal Φs on the start pulse line is dropped to 0V. By this, the gate potential of the first shift thyristor Tn−1 is lowered from 5V to 1.7V, so that the threshold voltage becomes 3.2V, and therefore it can be turned on by a signal from the transfer line Φ1. Voltage 5V is applied to the transfer line Φ1, and 5V is supplied to the start pulse line Φs, slightly after the first shift thyristor Tn−1 is turned on, and thereafter, 5V is continuously supplied to the start pulse line Φs.

The structure is such that the transfer line Φ1 and the transfer line Φ2 have a time period Tov where the ON states (5V in this case) overlap each other, and are in a substantially complementary relationship. The light-emitting thyristor lighting signal lines ΦW1 to ΦW4 are transmitted in half the cycle of the transfer lines Φ1 and Φ2, and lights light up when 5V is applied under the condition that the corresponding shift thyristor is on. For example, in the period a, all four light emitting thyristors connected to the same shift thyristor are turned on, and in the period b, the three light emitting thyristors are turned on simultaneously. In addition, in the period c, all the light emitting thyristors are turned off, and in the period d, the two light emitting thyristors are turned on simultaneously. In the period e, only one light-emitting thyristor is turned on.

In this embodiment, the number of light emitting thyristors connected to one shift thyristor is four, but it is not limited to this example, and may be less or more than four depending on the situation. Here, in the circuit described above, the cathode of each thyristor is shared, but an anode common circuit can be used by appropriately inverting the polarity.

As described above, in this embodiment, the cycle of the modulation frequency of the SSCG is set at the cycle which is twice the exposure cycle of the surface light emitting element array chip, whereby a cycle non-uniformity reduction effect of the modulation clock signal SS-CLK of the SSCG can be achieved to the maximum. In the case of this embodiment, in part (a) of FIG. 17, the component of the light and dark cycle non-uniformity of the image is moved from A to C (=1200 dpi=2400 dpi/2) in the sub-scan direction, and in addition, the residual component is moved from A to B. By this, the light and dark cycle non-uniformity of the image is made visually inconspicuous.

As described above, part (b) of FIG. 17 is the graph showing a visual characteristic of the Dooley, and shows a relationship between a distance from the original of part (a) of FIG. 17 and visual sensitivity. Part (a) of FIG. 17 shows arcs (dotted lines) passing through points A to E around the original, and points on the same arc have the same visual sensitivity. In part (a) of FIG. 17, on the axis of the main scan frequency, the points having the same visual sensitivity as the points A to E are represented by |A| to |E|, respectively, and are associated with |A| to |E| of the spatial frequency which is the abscissa of part (b) of FIG. 17 in parallel with the abscissa of part (a) of FIG. 17. In this embodiment, it is understood that the light and dark cycle non-uniformity of the image is caused to escape from a peak of the visual sensitivity in a high-frequency direction by moving the visual sensitivity point from |A| to |C| in the sub-scan direction and is caused to escape from a peak of the visual sensitivity in a low-frequency direction by moving the residual component from |A| to |B|.

Parts (a) and (b) of FIG. 10 are graphs each showing a relationship between the surface light emitting element array chip and the modulation cycle of the SSCG. In part (b) of FIG. 10, the abscissa represents a position of the light emitting element of the surface light emitting element array chip with respect to the main scan direction, and a region defined by two dotted lines on both sides with respect to the main scan direction shows one surface light emitting element array chip and a range in which the light emitting elements provided inside the one surface light emitting element array chip are disposed. Further, the ordinate represents frequency deviation by the SSCG from a deviation of 0 (in the figure) which is a reference frequency. With 0 as a boundary, a region on a lower side (dark gray portion in the figure) in which the frequency deviation is negative shows a deviation in a direction in which the frequency decreases, and a region on an upper side (light gray portion in the figure) in which the frequency deviation is positive shows a deviation in a direction in which the frequency increases. Further, part (b) of FIG. 10 shows, from an upper graph, first and second lines with respect to the sub-scan direction in the case of n=2, and first to fourth lines with respect to the sub-scan direction in the case of n=4. The modulation frequency of the first line in the case of n=2 changes in the following manner. That is, from the left side of the figure with respect to the main scan direction, the modulation frequency lowers from the reference frequency and becomes a minimum frequency at a center portion and increases further toward the right side with respect to the main scan direction, and is returned to the reference frequency for the right-end light emitting element in the figure. On the other hand, the modulation frequency of the second line changes in the following manner. That is, from the left side of the figure with respect to the main scan direction, the modulation frequency increases from the reference frequency and becomes a maximum frequency at a center portion and lowers further toward the right side with respect to the main scan direction, and is returned to the reference frequency for the right-end light emitting element in the figure.

On the other hand, part (a) of FIG. 10 is a schematic view showing a state of a density fluctuation with the frequency fluctuation by the SSCG in one surface light emitting element array chip in each of the cases of n=2 and 4. Part (a) of FIG. 10 shows, from an upper graph the density fluctuation of the surface light emitting element array chip on a first line and a second line with respect to the sub-scan direction in the case of n=2 and first to fourth lines with respect to the sub-scan direction in the case of n=4, and corresponds to the graphs of part (b) of FIG. 10. Incidentally, the abscissa of part (a) of FIG. 10 represents time, and the "SSCG W.L. (wavelength)" represents a length of one cycle of the SSCG. As described with reference to FIG. 6, in this embodiment, the one cycle of the SSCG is constituted so that the two lines with respect to the sub-scan direction, i.e., a scanning cycle corresponding to the two surface light emitting element array chips provide one cycle. For that reason, in the case of n=2, the first line and the second line with respect to the sub-scan direction are constituted so that phases of the frequencies of the SSCG on these lines cancel each other.

As described above, according to this embodiment, the light and dark residual component with respect to the main scan direction can be controlled so as to be made visually inconspicuous.

Embodiment 2

In the embodiment 1, the embodiment in which the cycle of the modulation frequency of the SSCG is set at the cycle which is twice the exposure cycle of the surface light emitting element array chip was described. In an embodiment 2, an embodiment in which the modulation frequency of the SSCG is set at a cycle which is four times the exposure cycle of the surface light emitting element array chip will be described. This embodiment is different from the embodiment 1 in control of the chip data converting portion 403, and therefore the difference will be described specifically. Incidentally, structures of the image forming apparatus, the exposure head 106, and constituent elements of the control substrate 415 excluding the chip data converting portion 403 are similar to those in the embodiment 1, and will be omitted from description.

In the control substrate 415, the clock generating portion 421 generates the clock signal CLK. The SSCG 422 generates a modulation clock signal SS-CLK on the basis of the clock signal CLK inputted from the clock generating portion 421. Further, the CPU 400 sets a cycle and strength of the modulation clock signal SS-CLK, which is a speed spectrum clock signal, for the SSCG 422. In this embodiment, the cycle of the modulation clock signal SS-CLK is set at a cycle which is four times the exposure cycle of one surface light emitting element array chip. The strength of the modulation clock signal SS-CLK is settable in a range of 0.1% to 5%, and is set at a small value in a range in which radiation noise of the main assembly of the image forming apparatus is sufficiently reduced.

In the chip data converting portion 403, writing and reading of the line memory 500 and writing of the memories 501 to 529 are carried out using the clock signal CLK. On the other hand, reading of the memories 501 to 529 is carried out using the modulation clock signal SS-CLK. FIG. 11 is a schematic view illustrating a state thereof. In the figure, the ordinate represents the modulation clock signal SS-CLK, the SSCG frequency, the line synchronizing signal, memory control, the line synchronizing signal 2 and the output data from the memory 501 in the order from above. The modulation clock signal SS-CLK shows a state of the clock signal supplied from the SSCG 422, and shows a high-frequency portion in a dark (thick) state and a low-frequency portion in a light (thin) state similarly as in FIG. 6 in the first embodiment. In this embodiment, a cycle of a modulation frequency of the modulation clock signal SS-CLK corresponds to four times the line synchronizing signal, i.e., corresponds to an exposure cycle of four line data. Incidentally, an enlarged view of a portion enclosed by an elliptical dotted line shows a signal waveform of the SS-CLK. Further, the SSCG frequency is a plot of a level of a frequency modulated on the basis of a reference frequency f0, and an upward direction in the figure is a frequency increasing direction and a downward direction in the figure is a frequency decreasing direction.

The writing of the image data in the memories 501 to 529 is carried out by the clock signal CLK based on the line synchronizing signal. On the other hand, reading of the image data from the memories 501 to 529 is carried out by the modulation clock signal SS-CLK based on the line synchronizing signal 2. For that reason, compared with the cycles (TL1 to TL6) of the line synchronizing signal, in a period in which the SSCG frequency is high, cycles (TL1', TL2', TL5', TL6') of the line synchronizing signal 2 are short, and on the other hand, in a period in which the SSCG frequency is low, cycles (TL3', TL4') of the line synchronizing signal 2 are long. In the states Tm1 and Tm2 synchronized with the line synchronizing signal and in the output data which is synchronized with the line synchronizing signal 2 which is outputted from the memories 501 to 529 to the chip data shift portion 404, timing of writing/reading fluctuates. In this embodiment, an offset period in which output timing of the data from the memories 501 to 529 to the chip data shift portion 404 is offset on the basis of the line synchronizing signal 2 by a period CntOfs is provided. By providing the offset period CntOfs, it is possible to carry out control so that a writing period in the memories 501 to 529 and a reading period from the memories 501 to 529 do not overlap with each other.

As described above, in this embodiment, the cycle of the modulation frequency of the SSCG is set at the cycle which is four times the exposure cycle of the surface light emitting element array chip, whereby a cycle non-uniformity reduction effect of the modulation clock signal SS-CLK of the SSCG can be achieved to the maximum. In the case of this embodiment, in part (a) of FIG. 17, the component of the light and dark cycle non-uniformity of the image is moved from A to D (=600 dpi=2400 dpi/4) in the sub-scan direction, and in addition, the residual component is moved from A to B. By this, the light and dark cycle non-uniformity of the image is made visually in conspicuous inconspicuous. In this embodiment, it is understood that in FIG. 17, the light and dark cycle non-uniformity of the image is caused to escape from a peak of the visual sensitivity in a high-frequency direction by moving the visual sensitivity point from |A| to |D| in the sub-scan direction and is caused to escape from a peak of the visual sensitivity in a low-frequency direction by moving the residual component from |A| to |B|.

Parts (a) and (b) of FIG. 10 are graphs each showing a relationship between the surface light emitting element array chip and the modulation cycle of the SSCG. Further, part (b) of FIG. 10 shows, from an upper graph, first and second lines with respect to the sub-scan direction in the case of n=2, and first to fourth lines with respect to the sub-scan direction in the case of n=4. In the figure, from the left side toward the right side with respect to the main scan direction, the frequency of the modulation clock signal SS-CLK of the first line in the case of n=4 lowers from the reference frequency and becomes a minimum frequency in the right end with respect to the main scan direction. Next, in the figure, from the left side toward the right side with respect to the main scan direction, the frequency of the modulation clock signal SS-CLK of the second line in the case of n=4 increases from the minimum frequency and returns to the reference frequency in the right end with respect to the main scan direction. Subsequently, in the figure, from the left side toward the right side with respect to the main scan direction, the frequency of the modulation clock signal SS-CLK of the third line in the case of n=4 increases from the reference frequency and becomes a maximum frequency in the right end with respect to the main scan direction. Then, in the figure, from the left side toward the right side with respect to the main scan direction, the frequency of the modulation clock signal SS-CLK of the fourth line in the case of n=4 lowers from the maximum frequency and returns to the reference frequency in the right end with respect to the main scan direction. On the other hand, part (a) of FIG. 10 is a schematic view showing a state of a density fluctuation with the frequency fluctuation by the SSCG in one surface light emitting element array chip in each of the cases of n=2 and 4. Part (a) of FIG. 10 shows, from an upper graph the density fluctuation of the surface light emitting element array chip on a first line and a second line with respect to the sub-scan direction in the case of n=2 and first to fourth lines with respect to the sub-scan direction in the case of n=4, and corresponds to the graphs of part (b) of FIG. 10. Incidentally, the abscissa of part (a) of FIG. 10 represents time, and the "SSCG W.L. (wavelength)" represents a length of one cycle of the SSCG. As described with reference to FIG. 6, in this embodiment, the one cycle of the SSCG is constituted so that the four lines with respect to the sub-scan direction, i.e., a scanning cycle corresponding to the four surface light emitting element array chips, provide one cycle (¼ cycle for one line with respect to the sub-scan direction). For that reason, in the case of n=4, each of a pair of the first and third lines and a pair of the second and fourth lines with respect to the sub-scan direction is constituted so that phases of the frequencies of the SSCG on these lines cancel each other.

Further, even when the cycle of the modulation frequency of the SSCG is n times (n=integer, n≥2) the cycle of the exposure scanning of the surface light emitting element array chip, it is possible to expect a phase canceling effect to some extent. Particularly, of the number n, by employing the m-th power of 2 ($n=2^m$, m≥1, m: integer), it is possible to provide a relationship such that phases of the SSCG are just canceled. When m=3 is used, in part (a) of FIG. 17, a component of the light and dark cycle non-uniformity of the image is moved from A to E (300 dpi=2400 dpi/8) (from |A| to |E| in part (a) of FIG. 17). With a larger m, a degree of the fluctuation in cycle non-uniformity with respect to the main scan direction becomes smaller, but the spatial frequency with respect to the sub-scan direction becomes lower. For example, from values of m providing not more than about 0.4 mm/cycle corresponding to ½ of the peak value of the visual sensitivity shown in part (b) of FIG. 17, a balanced value at which the light and dark cycle non-uniformity of the image is inconspicuous with respect to the sub-scan direction and the main scan direction may also be selected.

Further, in the above-described embodiment, after the power source switch of the image forming apparatus is turned on, the SSCG cycle (the cycle of the modulation clock signal SS-CLK) was set in synchronism with the cycle of the exposure scanning of the surface light emitting element array chip. For example, in the case where the exposure scanning cycle of the surface light emitting element array chip is changed for switching the print speed of the image forming apparatus, the SSCG cycle may also be set again in synchronism with an exposure cycle of a new surface light emitting element array chip. Further, the SSCG 422 may also be incorporated in the control substrate 415 so that the SSCG is actuated in the SSCG cycle so as to satisfy the cycle relationship in this embodiment in synchronism with the exposure scanning cycle. Incidentally, in the above-described embodiment, as the light emitting elements of the surface light emitting element array chip, the LEDs were used, but other light emitting elements such as organic EL elements may also be used.

As described above, according to this embodiment, the light and dark residual component with respect to the main scan direction can be controlled so as to be made visually inconspicuous.

Incidentally, in the above-described embodiments, the CPU 400, the image data generating portion 401, the chip data converting portion 403, the chip data shift portion 404, the data sending portion 405, the synchronizing signal generating portion 406, and the clock generating portion 421 are constituted by at least one integrated circuit. Further, a part of the functional blocks of the driving portion 303*a* may also be incorporated as one component part of the above-described integrated circuit.

According to the present invention, the light and dark residual component with respect to the main scan direction can be controlled so as to be made visually inconspicuous.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-079107 filed on Apr. 18, 2019, which is hereby incorporated by reference herein in its entirety.

What is claimed is:

1. An image forming apparatus comprising:

a photosensitive member rotatable in a first direction;

an exposure portion including a plurality of surface light emitting element arrays arranged in a second direction substantially perpendicular to the first direction and configured to expose said photosensitive member to light by said surface light emitting element arrays; and a clock generating portion configured to generate a clock signal, wherein said clock generating portion generates a reference clock signal for controlling light emission timing and a spread spectrum modulation clock signal obtained by subjecting the reference clock signal to frequency modulation, wherein each of said surface light emitting element arrays includes a plurality of light emitting elements for exposing said photosensitive member to light, wherein said exposure portion exposes said photosensitive member to light by sequentially subjecting a predetermined number of said light emitting elements of each of said surface light emitting element arrays to light emission control on the basis of a signal obtained by subjecting the modulation clock signal to modulation with image data, and wherein a modulation cycle in which a frequency of the modulation clock signal is modulated is n times (n: integer of n>1) an exposure cycle which is a time in which said light emitting elements of each of said surface light emitting element arrays are subjected to the light emission control on the basis of the reference clock signal.

2. An image forming apparatus according to claim 1, wherein $n=2^m$ (m: positive integer).

3. An image forming apparatus according to claim 2, wherein n is determined on the basis of a value of m which is not more than 0.4 mm/cycle when said modulation cycle is a converted cycle of a spatial frequency.

4. An image forming apparatus according to claim 3, further comprising control means configured to control the cycle of said modulation clock signal, wherein said control means provides an instruction to said clock generating portion so as to make the modulation cycle of said modulation clock signal n times the exposure cycle.

5. An image forming apparatus according to claim 4, wherein said clock generating portion generates the modulation clock signal of which modulation cycle is n times said exposure cycle by modulating a frequency through an increase in or a decrease in a clock number with a reference frequency which is a frequency of said reference clock signal as a center, depending on an instruction of n times by said control means.

6. An image forming apparatus according to claim 5, wherein n is 2, wherein in a half cycle of said modulation cycle corresponding to one exposure cycle, said clock generating portion generates a modulation clock signal obtained by modulating the frequency to a frequency higher than the frequency of said reference clock signal through the increase in clock number above said reference frequency, and wherein in a half cycle subsequent to said half cycle of said modulation cycle, said clock generating portion generates a modulation clock signal obtained by modulating the frequency to a frequency lower than the frequency of said reference clock signal through the decrease in clock number below said reference frequency.

7. An image forming apparatus according to claim 5, wherein n is 4, wherein in a first ¼ cycle of said modulation cycle corresponding to one exposure cycle, said clock generating portion generates a modulation clock signal obtained by modulating the frequency to a frequency higher than the frequency of said reference clock signal through the increase in clock number from said reference frequency, wherein in a second ¼ cycle subsequent to said first ¼ cycle, said clock generating portion generates a modulation clock signal obtained by modulating the frequency to said reference frequency through the decrease in clock number from said frequency higher than the frequency of said reference clock signal, wherein in a third ¼ cycle subsequent to said second ¼ cycle, said clock generating portion generates a modulation clock signal obtained by modulating the frequency to a frequency lower than the frequency of said reference clock signal through the decrease in clock number from said reference frequency, and wherein in a fourth ¼ cycle subsequent to said third ¼ cycle, said clock generating portion generates a modulation clock signal obtained by modulating the frequency to said reference frequency through the increase in clock number from said frequency lower than the frequency of said reference clock signal.

* * * * *